US010414468B2

(12) United States Patent
Dennehy

(10) Patent No.: US 10,414,468 B2
(45) Date of Patent: Sep. 17, 2019

(54) CUSHIONS FOR USE IN SEATING FOR BOATS AND METHODS OF USING SAID CUSHIONS

(71) Applicant: Martin J. Dennehy, Dedham, MA (US)

(72) Inventor: Martin J. Dennehy, Dedham, MA (US)

(73) Assignee: REGAL BOAT SEAT CUSHIONS INC., Wrentham, MA (US)

( * ) Notice: Subject to any disclaimer, the term of this patent is extended or adjusted under 35 U.S.C. 154(b) by 0 days.

(21) Appl. No.: 15/646,457

(22) Filed: Jul. 11, 2017

(65) Prior Publication Data

US 2017/0320551 A1 Nov. 9, 2017

Related U.S. Application Data

(63) Continuation-in-part of application No. 29/563,731, filed on May 6, 2016, now Pat. No. Des. 823,025, and
(Continued)

(51) Int. Cl.

| | |
|---|---|
| ***A47C 7/18*** | (2006.01) |
| ***B63B 29/04*** | (2006.01) |
| ***A47C 7/02*** | (2006.01) |

(52) U.S. Cl.
CPC ..... *B63B 29/04* (2013.01); *A47C 7/021* (2013.01); *A47C 7/18* (2013.01); *B63B 2029/043* (2013.01)

(58) Field of Classification Search
CPC ... B63B 29/04; B63B 2029/043; A47C 7/021; A47C 7/18; A47G 9/1018; A47G 9/1009;
(Continued)

(56) References Cited

U.S. PATENT DOCUMENTS

| | | | |
|---|---|---|---|
| 2,782,840 | A | 2/1957 | Armbrecht |
| 3,046,573 | A | 7/1962 | Davis, Sr. et al. |

(Continued)

FOREIGN PATENT DOCUMENTS

| | | | |
|---|---|---|---|
| GB | 2165623 | A | 9/1985 |
| GB | 2502508 | A | 12/2013 |
| JP | 2010221861 | A | 10/2010 |

OTHER PUBLICATIONS

"Wise Deluxe Pontoon," Restore Pontoon, restorepontoon.com, SKU: WD125-CO-xxxx, accessed: Jan. 15, 2016. http://www.restorepontoon.com/pontoon/pc/viewPrd.asp?idproduct=3042.

(Continued)

*Primary Examiner* — Mark R Wendell
(74) *Attorney, Agent, or Firm* — Kriegsman & Kriegsman

(57) ABSTRACT

Cushions for use in seating for boats and methods of using the same. According to one embodiment, the cushion is designed for use with a bucket-type boat seat and includes an insert and a casing. The insert has a J-shape and is made up of three foam pads joined to one another, with a first of the foam pads designed to be positioned over the boat seat, with a second of the foam pads designed to be positioned in front of the boat seat, and with a third of the foam pads designed to be positioned under the boat seat. The casing preferably conforms substantially to the shape of the insert and is designed to permit the insert to be inserted into and/or removed from the casing. The cushion additionally includes a fastener coupled to the casing for use in securing the casing to the boat seat.

8 Claims, 25 Drawing Sheets

Related U.S. Application Data a continuation-in-part of application No. 29/563,721, filed on May 6, 2016, now abandoned.

(60) Provisional application No. 62/360,520, filed on Jul. 11, 2016.

(58) Field of Classification Search
CPC .. A47G 9/1027; A47G 9/1045; A47G 9/1063; A47G 9/1072; A47G 9/1081
USPC ..... 297/228.13, 225
See application file for complete search history.

(56) References Cited

U.S. PATENT DOCUMENTS 3,369,262 A 2/1968 Judd
3,903,554 A 9/1975 Dodd
4,190,918 A 3/1980 Harvell
4,212,496 A * 7/1980 Kirkham, Jr. ..... A47C 31/023 297/219.1
4,291,916 A 9/1981 Chardon
4,729,599 A * 3/1988 Nissen ..... E04H 3/12 297/219.1
4,789,046 A 12/1988 McDowall
4,802,249 A 2/1989 Bills
4,926,783 A 5/1990 Lathers
D315,076 S 3/1991 Hanna
D315,993 S 4/1991 Wenderoth
5,029,928 A 7/1991 Huber
5,070,664 A * 12/1991 Groh ..... A47C 1/16 52/177
D324,769 S 3/1992 Hart
D324,970 S 3/1992 Kane
D328,001 S 7/1992 Kelly
5,171,063 A 12/1992 Stidd
D336,791 S 6/1993 Stidd
D362,579 S 9/1995 Short
D366,383 S 1/1996 Briegleb
D366,800 S 2/1996 Moore, Jr.
5,491,851 A 2/1996 Alonso
D376,701 S 12/1996 Thompson
5,619,949 A 4/1997 Dick, Jr.
D379,047 S 5/1997 Richard
D381,855 S 8/1997 Galick
D382,756 S 8/1997 Ryan
5,857,423 A 1/1999 Imaeda et al.
5,921,626 A * 7/1999 Baker ..... A47C 7/021 297/219.1
5,950,263 A 9/1999 Hanson et al.
6,042,093 A 3/2000 Garelick
6,325,456 B1 12/2001 Carnahan
D462,862 S * 9/2002 Thayer, Jr. ..... D6/601
D463,701 S 10/2002 Borcherding et al.
D474,934 S 5/2003 Ildstad et al.
6,692,076 B1 * 2/2004 Burer ..... A47C 7/56 297/331
D503,867 S 4/2005 Bennette et al.
D572,069 S 7/2008 McQueen
D575,536 S 8/2008 Bizzell et al.
7,523,988 B1 4/2009 Ratza et al.
D602,298 S 10/2009 Zwanzgleitner et al.
D634,951 S 3/2011 Dreiling
D635,265 S 3/2011 Coffey et al.
8,336,965 B2 12/2012 Kismarton et al.
D677,506 S 3/2013 Lai
D695,548 S 12/2013 Johnson
D696,532 S 12/2013 von Saher
D702,979 S 4/2014 Jannetides et al.
8,695,136 B2 4/2014 Pozzi
8,702,120 B2 4/2014 Kalisz et al.
8,782,835 B2 7/2014 Pozzi
D713,664 S 9/2014 Vetter et al.
8,910,330 B1 12/2014 Malik
D725,923 S 4/2015 Kaye
D725,924 S 4/2015 Kaye
D725,925 S 4/2015 Kaye
9,045,197 B2 6/2015 Chen
D737,073 S 8/2015 Hawkins
D740,043 S 10/2015 Lee
D747,117 S 1/2016 Lau
D749,873 S 2/2016 Latrofa
D769,028 S 10/2016 Little
D775,484 S 1/2017 Moore
D790,235 S 6/2017 Chuah
2005/0138733 A1 6/2005 Riesberg et al.
2005/0177944 A1 * 8/2005 Kang ..... A47G 9/1081 5/636
2006/0022499 A1 * 2/2006 Jones ..... A47C 1/16 297/352
2007/0001503 A1 1/2007 Brady
2008/0178789 A1 * 7/2008 Roehm ..... B63B 29/04 114/363
2008/0315644 A1 12/2008 Briscoe
2010/0037814 A1 2/2010 Sahr et al.
2012/0256466 A1 10/2012 Lievestro et al.
2013/0263377 A1 * 10/2013 Wootten, Jr. ..... A47C 23/00 5/640
2014/0117738 A1 * 5/2014 Takahashi ..... B60N 2/7035 297/452.56
2015/0158560 A1 * 6/2015 Velasquez ..... B63B 35/85 297/250.1
2015/0359353 A1 * 12/2015 Vainberg ..... A47C 31/116 5/652.1
2016/0192794 A1 7/2016 Boyd
2016/0296031 A1 10/2016 Sramek
2016/0338514 A1 11/2016 Chan

OTHER PUBLICATIONS

"Ladder Back Pilot Chair 1095 with Cushions, 15" Fixed Pedestal and Seat Slide—Wise Boat Seats," iboats™, iboats.com, Part # WD1095-710, Jan. 15, 2016. http://www.iboats.com/Ladder-Back-Pilot-Chair-1095-with-Cushions-15-Fixed-Pedestal-and-Seat-Slide-Wise-Boat-Seats/dm/cart_id.464238942--session_id.419910167--view_id.375626.

"Deluxe Off White/Charcoal Vinyl Boat Bolster/Bucket/Drivers Seating Seat Chairs (Pair)," Great Lakes Skipper™, greatlakesskipper.com, GLS Stock #: 1045989, Part #: M2540BB00307, Jan. 15, 2016 http://greatlakesskipper.com/deluxe-off-white-charcoal-vinyl-boat-bolster-bucket-drivers-seating-seat-chairs-pair.

Jim Buoy Flotation Cushion, available at least on Aug. 27, 2013, [online], [site visited Aug. 2, 2017]. Available from Internet, <URL:http://www.defender.com/category.jsp?path=-1%7C135%7C2290066&id=2290114>.

U.S. Appl. No. 29/563,721, inventor Martin J. Dennehy, filed May 6, 2016.

U.S. Appl. No. 29/563,731, inventor Martin J. Dennehy, filed May 6, 2016.

U.S. Appl. No. 29/627,572, inventor Martin J. Dennehy, filed Nov. 28, 2017.

U.S. Appl. No. 29/627,592, inventor Martin J. Dennehy, filed Nov. 28, 2017.

U.S. Appl. No. 29/630,607, inventor Martin J. Dennehy, filed Dec. 21, 2017.

Millennium ComfortMax SW-200 Saltwater Casting Boat Seat, accessed Oct. 2, 2017, http://www.basspro.com/shop/en/millennium-comfortmax-sw-200-sallwater-casting-boat-seat.

Millennium ComfortMax SW-200 Saltwater Casting Boat Seat, accessed Dec. 22, 2017, http://www.millenniummarine.com/sw-series/sw-200/sw-200-white/.

Tempress Guide Series Casting Seat, accessed Oct. 2, 2017, http://www.basspro.com/shop/en/tempress-guide-series-casting-seat.

Tempress Guide Series Casting Seat, accessed Dec. 22, 2017, https://tempress.com/store/TEMPRESS-Guide-Series-Casting-Seat-Blue-Gray-p36736269.

Safety Data Sheet Polyurethane Foam, Crest Foam Industries, Inc., Moonachie, New Jersey (Mar. 2016).

* cited by examiner 17-1
17-2
33
33
31
31
11
19-2
19-1
15
35
35
22
37
37
21
23
24
25
26

17-1
17-2
33
33
31
31
11
19-1
19-2
15
35
37
37
35
$l_3$
$l_2$
$l_3$
$l_1$

CUSHIONS FOR USE IN SEATING FOR BOATS AND METHODS OF USING SAID CUSHIONS

CROSS-REFERENCE TO RELATED APPLICATIONS

The present application is a continuation-in-part of U.S. patent application Ser. No. 29/563,721, inventor Martin J. Dennehy, filed May 6, 2016, and additionally is a continuation-in-part of U.S. patent application Ser. No. 29/563,731, inventor Martin J. Dennehy, filed May 6, 2016, and also claims the benefit under 35 U.S.C. 119(e) of U.S. Provisional Patent Application No. 62/360,520, inventor Martin J. Dennehy, filed Jul. 11, 2016, the disclosures of all of the foregoing applications being incorporated herein by reference.

BACKGROUND OF THE INVENTION

The present invention relates generally to cushions of the type that are used in connection with seating for boats and relates more particularly to novel such cushions and to methods of using the same.

Many recreational boats are constructed by a boat manufacturer with one or more low-cost, molded polymer or composite-type material, "bucket-type" seats. Usually, the boat manufacturer provides a decorative seat cushion for attachment to each bucket-type seat; however, a cushion of this type only covers the horizontal top seating surface of the bucket-type seat. Moreover, such a cushion is typically made from a flimsy grade of foam filling, which does not provide much cushioning to the person seated thereon.

Other recreational boats are equipped with a type of luxury seat that is commonly referred to as a bolster-type seat. Such a seat typically includes a cushioned extension, also known as a bolster, that usually has a generally square, transverse cross-sectional shape (e.g., approximately 7×7 inches or approximately 8×8 inches as viewed from the end of the bolster). The bolster is pivotally attached to the main seat portion and may be positioned in a "down" position, in which the bolster is positioned in front of the front end of the main seat portion (thereby extending the available seating area for a user), and an "up" position, in which the bolster is positioned on top of the main seat portion. Typically, the bolster retains its form, shape, and rigidity due to a ¾-inch or 1-inch piece of encased plywood that forms the "base" of the bolster. When the bolster is in the "up" position and a person stands and/or leans against the bolster or even sits on the top surface of the bolster, this piece of plywood, which is now positioned at the front of the bolster, can be felt by the person and may be a source of discomfort.

As a boat begins to move forward, its operating characteristics change. More specifically, a phenomenon known as "getting on plane" or "planing" typically occurs. Simply put, as the forward speed of a boat increases, the bow (i.e., the front) of the boat rises up out of the water. Being on plane is a desirable state. "Planing" lifts the front portion of the boat up and out of the water. The faster a boat travels, the more the front portion of the hull comes up and out of the water. An advantage to planing is that fuel efficiency is dramatically improved. This is because it is easier to ride on top of the water than having to push water out of the path of the boat.

As the boat rises up out of the water, a boat operator typically tends to stand at the helm (i.e., the steering wheel), as opposed to remaining seated. Standing at the helm allows for better visibility of the boat operator over the bow of the boat while the boat is planing. Otherwise, if the boat operator remains seated, his field of view is blocked by the bow of the boat, which has risen out of the water. As the operator stands, he typically holds onto the helm with both hands and, at the same time, leans back against the front edge of the seat with the back of his upper thighs and hips to brace himself and to maintain his stability. This position best assists the operator in staying in place at the controls. Unfortunately, however, operators consider this leaning position to be uncomfortable. Moreover, this position can lead to injury, typically to the operator's hips, upper thighs and/or spine (i.e., spinal compression), as the operator may have his body repeatedly contacted with and/or slammed against the seat as the boat vibrates and moves through the water.

SUMMARY OF THE INVENTION

It is an object of the present invention to provide a novel cushion of the type for use in seating for boats.

Therefore, according to one aspect of the invention, there is provided a cushion suitable for mounting on a horizontal seating surface of a boat seat, the cushion comprising: (a) an insert, the insert comprising an impact damping material, the insert having a J-shape and comprising a top portion adapted to be positioned over the horizontal seating surface of the boat seat, a front portion adapted to be positioned in front of the horizontal seating surface of the boat seat, and a bottom portion adapted to be positioned under the horizontal seating surface of the boat seat; (b) a casing, the insert being disposed within the casing; and (c) a fastener, the fastener coupled to the casing for use in securing the casing to the boat seat.

According to a more detailed feature of the invention, the insert may comprise at least one foam pad.

According to a more detailed feature of the invention, the insert may comprise a first foam pad, a second foam pad, and a third foam pad, and the second foam pad may be sandwiched between and adhered to the first foam pad and the third foam pad.

According to a more detailed feature of the invention, the casing may comprise at least two pieces detachably joined to one another to permit the insert to be inserted into and/or removed from the casing.

According to a more detailed feature of the invention, the fastener may comprise a hook and loop fastener on the casing adapted to mate with a complementary hook and loop fastener on the horizontal seating surface of the boat seat.

According to another aspect of the invention, there is provided a cushion suitable for mounting on a bolster of a bolster-type boat seat, the cushion comprising (a) an insert, the insert comprising an impact damping material; (b) a casing, the insert being disposed within the casing, the casing comprising a first end and a second end; and (c) a fastener for detachably securing the first end of the casing to the second end of the casing.

According to a more detailed feature of the invention, the insert may comprise at least one foam pad.

According to a more detailed feature of the invention, the at least one foam pad may comprise a notch to facilitate bending the foam pad.

According to a more detailed feature of the invention, the casing may comprise at least two pieces detachably joined to one another to permit the insert to be inserted into and/or removed from the casing.

According to a more detailed feature of the invention, the fastener may comprise a hook and loop fastener mounted on the first end of the casing and a complementary hook and loop fastener mounted on the second end of the casing.

It is another object of the present invention to provide a method of using a boat seat cushion.

Therefore, according to one aspect of the invention, there is provided a method, the method comprising (a) providing a bucket-type boat seat, the bucket-type boat seat comprising a horizontal seating surface and a first fastener; (b) providing a cushion, the cushion comprising (i) an insert, the insert comprising an impact damping material, the insert having a J-shape and comprising a top portion adapted to be positioned over the horizontal seating surface of the bucket-type boat seat, a front portion adapted to be positioned in front of the horizontal seating surface of the bucket-type boat seat, and a bottom portion adapted to be positioned under the horizontal seating surface of the bucket-type boat seat; (ii) a casing, the insert being disposed within the casing; and (iii) a second fastener, the second fastener coupled to the casing and being securable to the first fastener of the bucket-type boat seat; (b) mounting the cushion on the horizontal seating surface of the bucket-type boat seat so that the top portion of the insert is positioned over the horizontal seating surface of the bucket-type boat seat, so that the front portion of the insert is positioned in front of the horizontal seating surface of the bucket-type boat seat, and so that the bottom portion of the insert is positioned under the horizontal seating surface of the bucket-type boat seat; and (c) securing the second fastener of the cushion to the first fastener of the bucket-type boat seat.

According to a more detailed feature of the invention, the insert may comprise at least one foam pad.

According to a more detailed feature of the invention, the insert may comprise a first foam pad, a second foam pad, and a third foam pad, the second foam pad being sandwiched between and adhered to the first foam pad and the third foam pad.

According to a more detailed feature of the invention, the casing may comprise at least two pieces detachably joined to one another to permit the insert to be inserted into and/or removed from the casing.

According to a more detailed feature of the invention, the first fastener and the second fastener may comprise complementary hook and loop fasteners.

According to another aspect of the invention, there is provided a method, the method comprising: (a) providing a bolster-type boat seat, the bolster-type boat seat comprising a bolster, the bolster comprising a rigid frame; (b) providing a cushion, the cushion comprising (i) an insert, the insert comprising an impact damping material, (ii) a casing, the insert being disposed within the casing, the casing comprising a first end and a second end, and (iii) a fastener for detachably securing the first end of the casing to the second end of the casing; (c) wrapping the cushion around the bolster so that the insert is positioned over the rigid frame of the bolster; and (d) securing the first end of the casing to the second end of the casing.

According to a more detailed feature of the invention, the insert may comprise at least one foam pad.

According to a more detailed feature of the invention, the at least one foam pad may comprise a notch to facilitate bending the foam pad.

According to a more detailed feature of the invention, the casing may comprise at least two pieces detachably joined to one another to permit the insert to be inserted into and/or removed from the casing.

According to a more detailed feature of the invention, the fastener may comprise a hook and loop fastener mounted on the first end of the casing and a complementary hook and loop fastener mounted on the second end of the casing.

For purposes of the present specification and claims, various relational terms like "top," "bottom," "proximal," "distal," "upper," "lower," "front," and "rear" may be used to describe the present invention when said invention is positioned in or viewed from a given orientation. It is to be understood that, by altering the orientation of the invention, certain relational terms may need to be adjusted accordingly.

Additional objects, as well as aspects, features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. These drawings are not necessarily drawn to scale, and certain components may have undersized and/or oversized dimensions for purposes of explication. In the drawings wherein like reference numerals represent like parts:

FIG. 9(*c*) is a bottom perspective view of the cushion shown in FIG. 9(*a*), the cushion being shown with the casing partly opened to reveal the insert disposed therewithin;

FIG. 20(*c*) is a bottom perspective view of the cushion shown in FIG. 20(*a*), the cushion being shown with the casing partly opened to reveal the insert disposed therewithin;

DETAILED DESCRIPTION OF THE INVENTION

Figure 1:
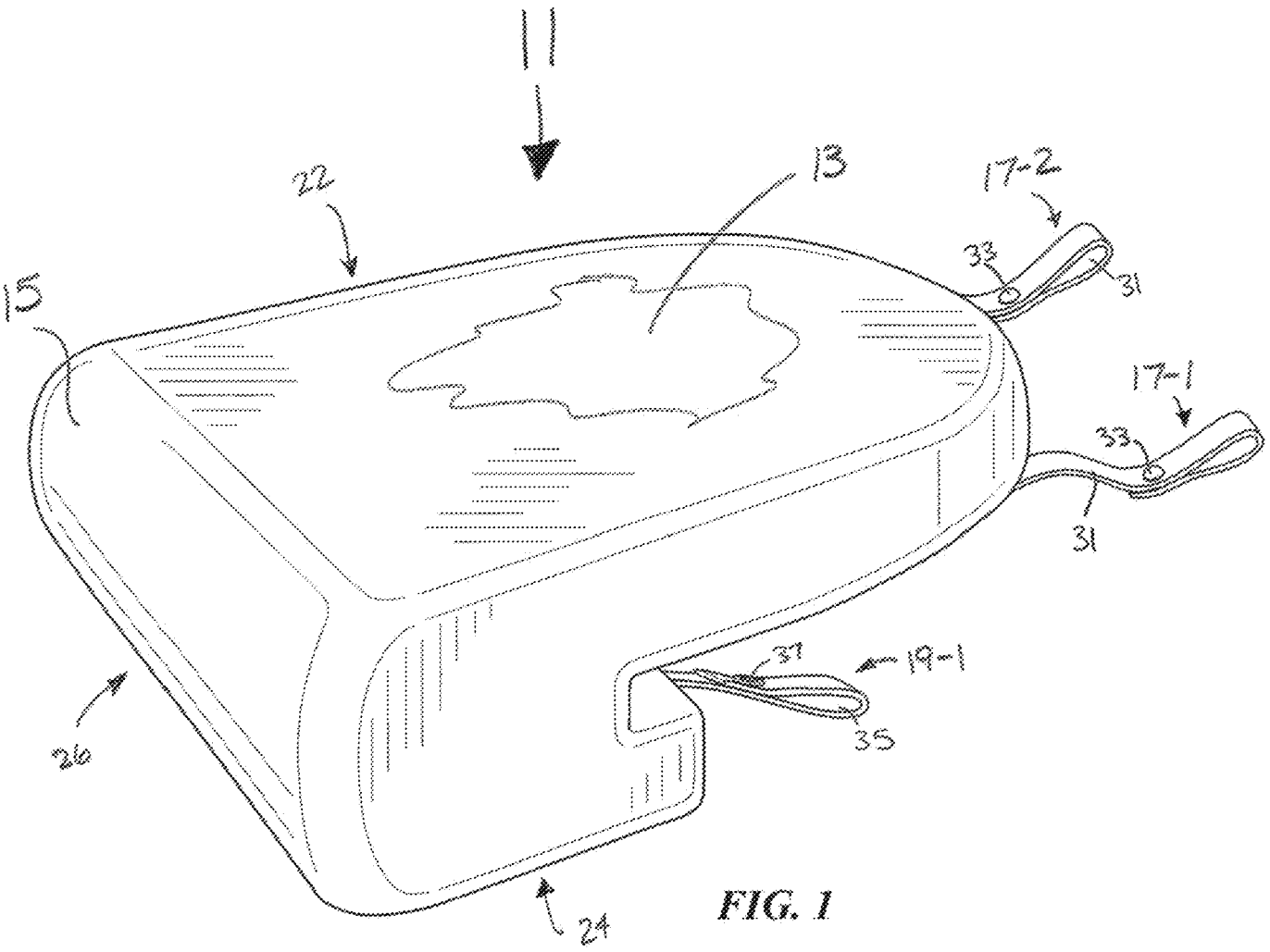
FIG. 1 is a perspective view, broken away in part, of a first embodiment of a cushion for use in seating for boats, the cushion being constructed according to the present invention.
Figure 2:
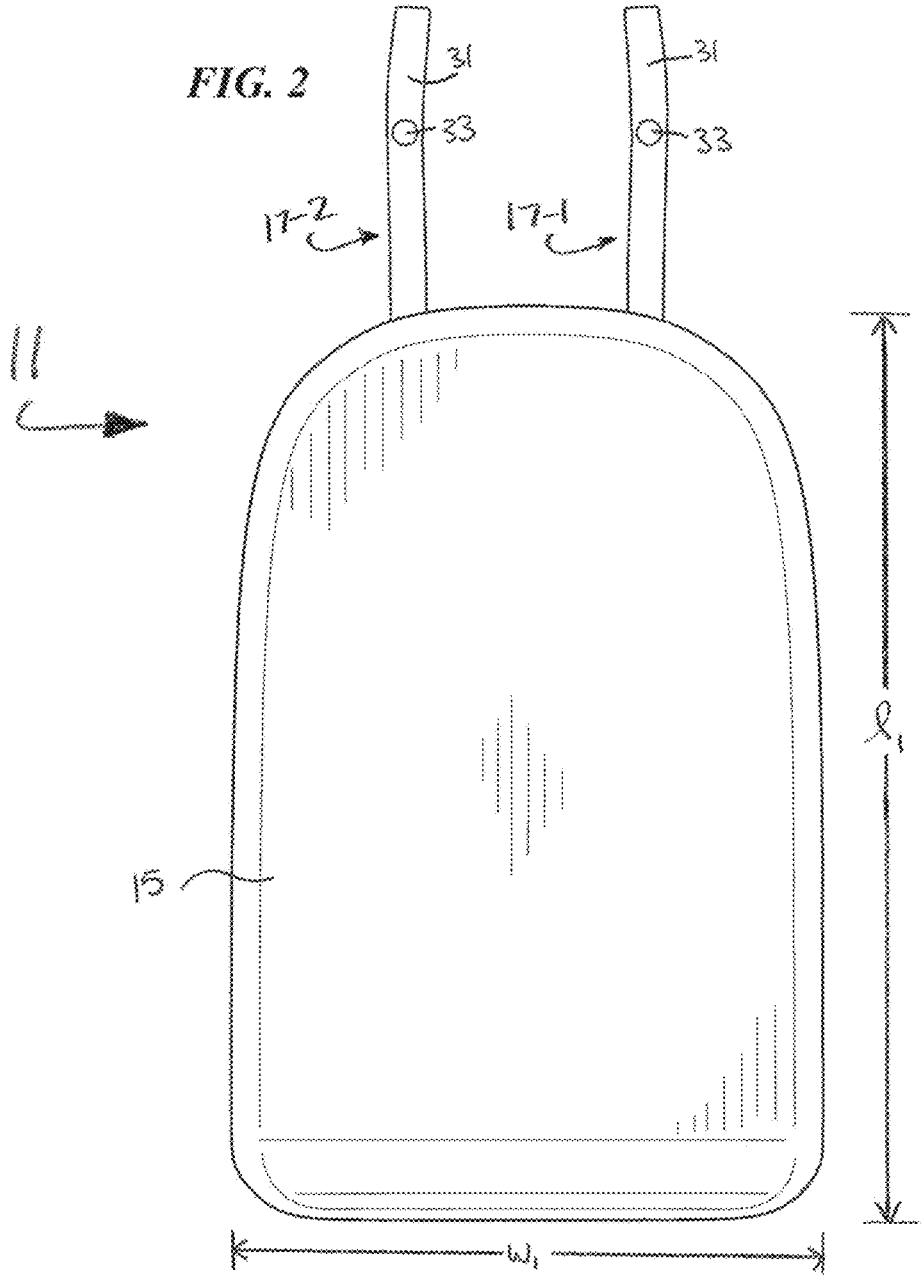
FIG. 2 is a top view of the cushion shown in FIG. 1.
Figure 3:
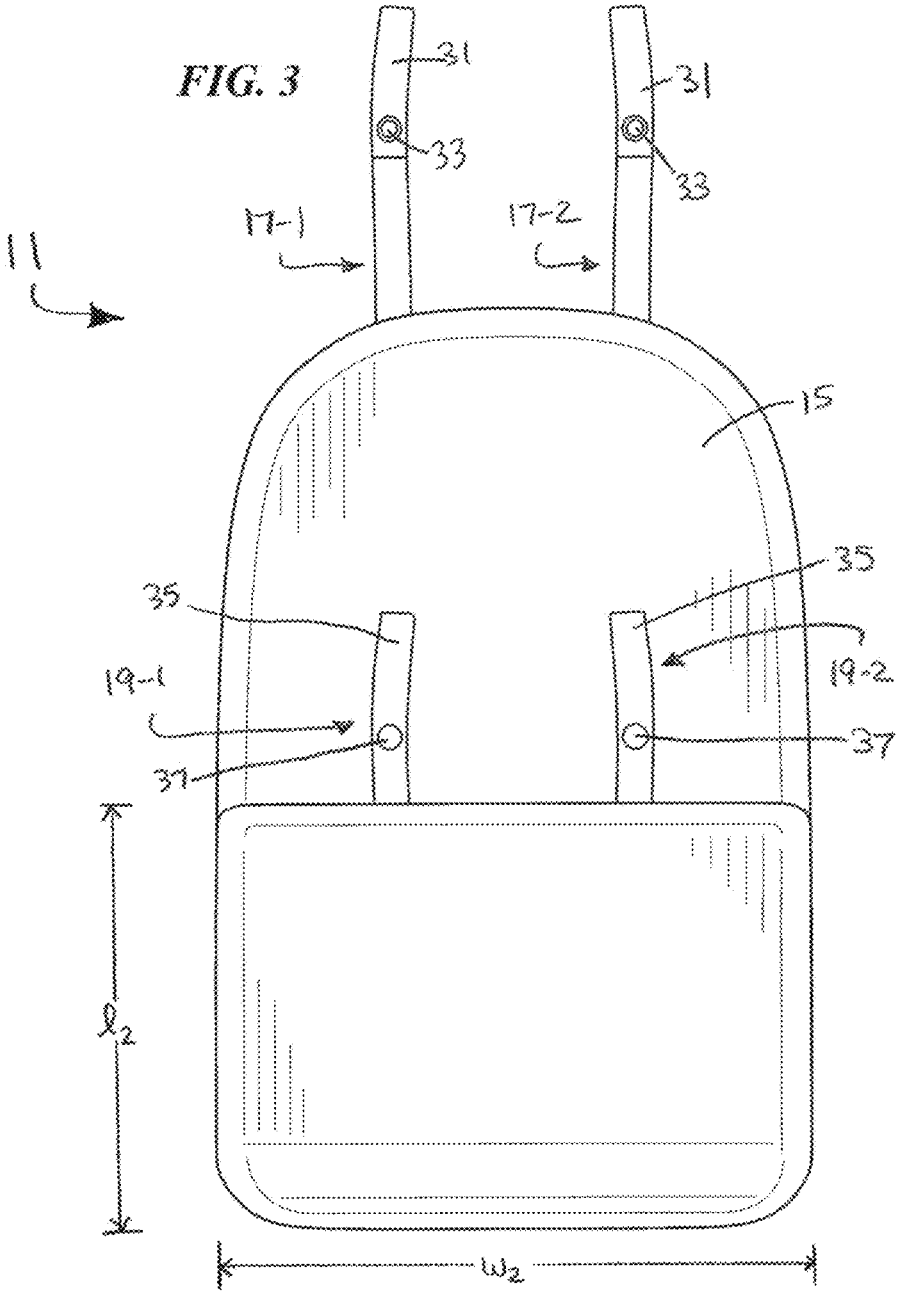
FIG. 3 is a bottom view of the cushion shown in FIG. 1.
Figure 4:
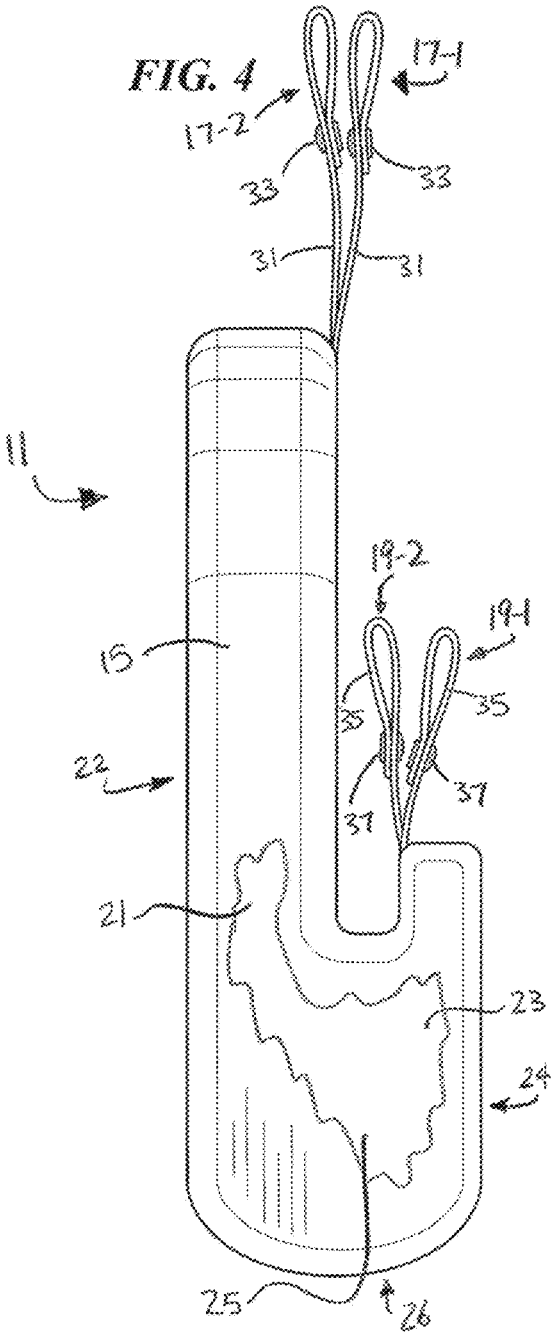
FIG. 4 is a right side view, broken away in part, of the cushion shown in FIG. 1.
Figure 5:
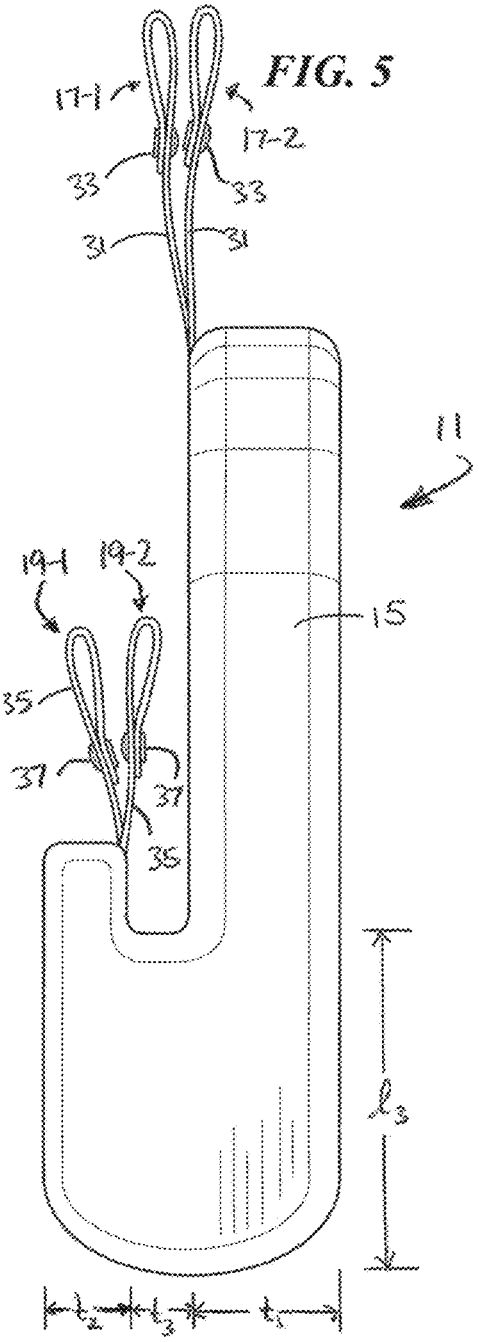
FIG. 5 is a left side view of the cushion shown in FIG. 1.
Figure 6:
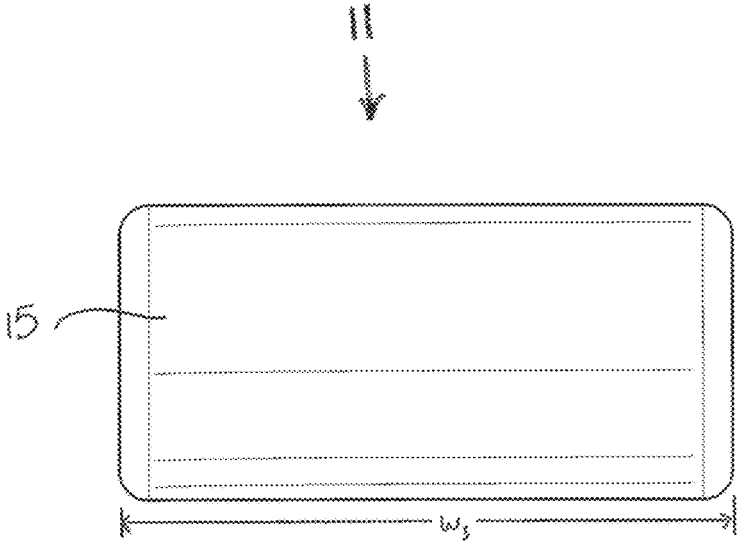
FIG. 6 is a front view of the cushion shown in FIG. 1.
Figure 7:
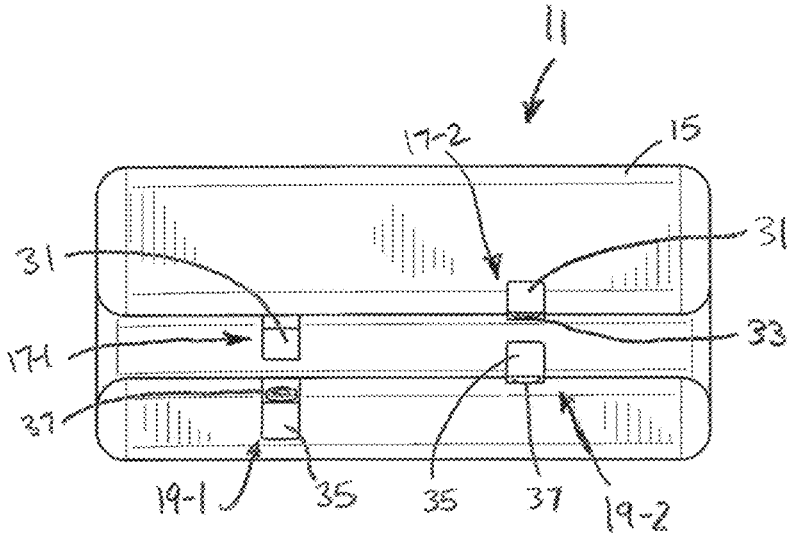
FIG. 7 is a rear view of the cushion shown in FIG. 1.

A purpose of the present invention is to provide boat operators with a cushion that reduces the severity of contact between the body of an operator and an exposed portion of a boat seat while the boat is being operated, especially when the boat is planing. In so doing, the cushion makes it more tolerable for a boat operator to stand and to lean back against the boat seat when the boat is planing, thereby enabling the operator to have better visibility and permitting safer operation of the boat than would be the case if the operator remained seated. The cushion of the present invention also offers increased comfort to passengers who, like the boat operator, may be standing and leaning back against a seat. Moreover, the cushion of the present invention provides increased comfort to both boat operators and passengers who remain seated, whether or not the boat is moving.

As will be described further below, certain embodiments of the present cushion are designed for attachment to the seat-portion of a bucket-type boating seat, and other embodiments of the present cushion are designed for attachment to a bolster of a bolster-type boating seat.

Referring now to FIGS. 1 through 7, there are shown various views of a first embodiment of a cushion constructed according to the present invention, the cushion being represented generally by reference numeral 11. As will be discussed further below, cushion 11 is specifically designed for attachment to the seat-portion of a bucket-type boating seat; however, it is to be understood that cushion 11 may have utility with other types of seats.

Cushion 11 may comprise an insert 13, a casing 15, a plurality of upper fastening mechanisms 17-1 and 17-2, and a plurality of lower fastening mechanisms 19-1 and 19-2.

Insert 13 comprises an impact damping material and may comprise, for example, a foam pad or a plurality of discrete foam pads. (Alternatively, insert 13 may comprise a material other than one or more foam pads.) The foam pad or plurality of discrete foam pads of insert 13 each may comprise a unitary foam piece or may comprise a plurality of foam pieces of similar or dissimilar composition joined to one another by adhesive or other suitable means. Preferably, insert 13 exhibits the resilience and compressibility of a closed cell foam with a foam industry typical description ranging from 2-24 to 2-30. Lighter grades of foam may be used but are less preferred. Insert 13 is preferably a generally J-shaped structure that comprises a top portion 21, a bottom portion 23, and a front portion 25. Although insert 13 is shown in the present embodiment as a one-piece structure, it is to be understood that top portion 21, bottom portion 23, and front portion 25 may be constructed as three separate pieces that are joined to one another using, for example, an adhesive.

Casing 15 preferably conforms substantially to the shape of insert 13 and preferably covers the substantial entirety of insert 13. Casing 15 is preferably a generally flexible, thin-walled, protective material and may comprise any of a variety of different materials including, but not limited to, marine-grade vinyl using industry specifications of 22 ounce to 30 ounce material. Lesser quality vinyl could also be used but is less preferred in terms of resistance to wear and tear. SUINBRELLA® fabric, medium weight NYLON® polyamide, and any water-resistant polyvinyl chloride (PVC) material may also be used for the casing. Casing 15 may be stitched with the stitching appearing on the inside seams and not visible on the outside. Casing 15 may also be stitched on the outside seams using a decorative "bead" to hide the actual seams. It is also possible to "glue" the seams together, or tape the seams together, but the use of glue or tape does not offer the security or the finish quality that stitching offers. Every external surface of insert 13 is preferably covered by the casing material.

Without wishing to be limited to any particular dimensions, insert 13 and casing 15 may collectively define a top portion 22 having a length $l_1$ of approximately 19 inches to 22 inches, a width $w_1$ of approximately 14 inches to 16 inches, and a thickness $t_1$ of approximately 1 to 2 inches. In addition, insert 13 and casing 15 may collectively define a bottom portion 24 having a length $l_2$ of approximately 8 inches to 12 inches, a width $w_2$ of approximately 14 to inches, and a thickness $t_2$ of approximately 2 inches to 3 inches. Moreover, insert 13 and casing 15 may collectively define a front portion 26 having a length $l_3$ of approximately 5 to 7 inches, a width $w_3$ of approximately 14 inches to 16 inches, and a thickness $t_3$ of approximately 1 to 2 inches.

Upper fastening mechanisms 17-1 and 17-2 may be secured by stitching or other suitable means to casing 15 proximate to the rear of top portion 21, and lower fastening mechanisms 19-1 and 19-2 may be secured by stitching or other suitable means to casing 15 proximate to the rear of bottom portion 23. In the present embodiment, upper fastening mechanisms 17-1 and 17-2 each may comprise a flexible strap 31 having a snap element 33 proximate to the free end thereof, and lower fastening mechanisms 19-1 and 19-2 each may comprise a flexible strap 35 having a snap element 37 proximate to the free end thereof. Snap elements 33 on upper fastening mechanisms 17-1 and 17-2 are designed to mate with corresponding snap elements 39 on the rear bottom of a bucket-type seat 41 with which cushion 13 is used (see FIG. 8). In a similar manner, snap elements 37 on lower fastening mechanisms 19-1 and 19-2 are designed to mate with corresponding snap elements 43 on the front bottom of the bucket-type seat 41 with which cushion 13 is used (see FIG. 8). As can be appreciated, straps 31 and 35 may have a length that is appropriate for the particular bucket-type seat 41. Alternatively, straps 31 and 35 may be constructed to be adjustable in length for use with differently dimensioned bucket-type seats 41.

To construct cushion 11, the dimensions of the horizontal seating surface of the bucket-type boat seat should be known. Most existing bucket-type boat seats have horizontal seating surfaces that range from 14×14 inches to 16×16 inches. As noted above, insert 13 may be produced as a unitary foam piece having a "J"-shape or may be assembled from a plurality of smaller foam pieces that are joined together by gluing or other suitable means. The foam piece or assembled foam pieces may be laid out and fit into a suitable casing material, and the casing material may then be stitched—either internally or externally—to form casing 15 with insert 13 disposed therewith. Finally, fastening mechanisms 17-1, 17-2, 19-1 and 19-2 may be attached to casing 15.

Figure 8:
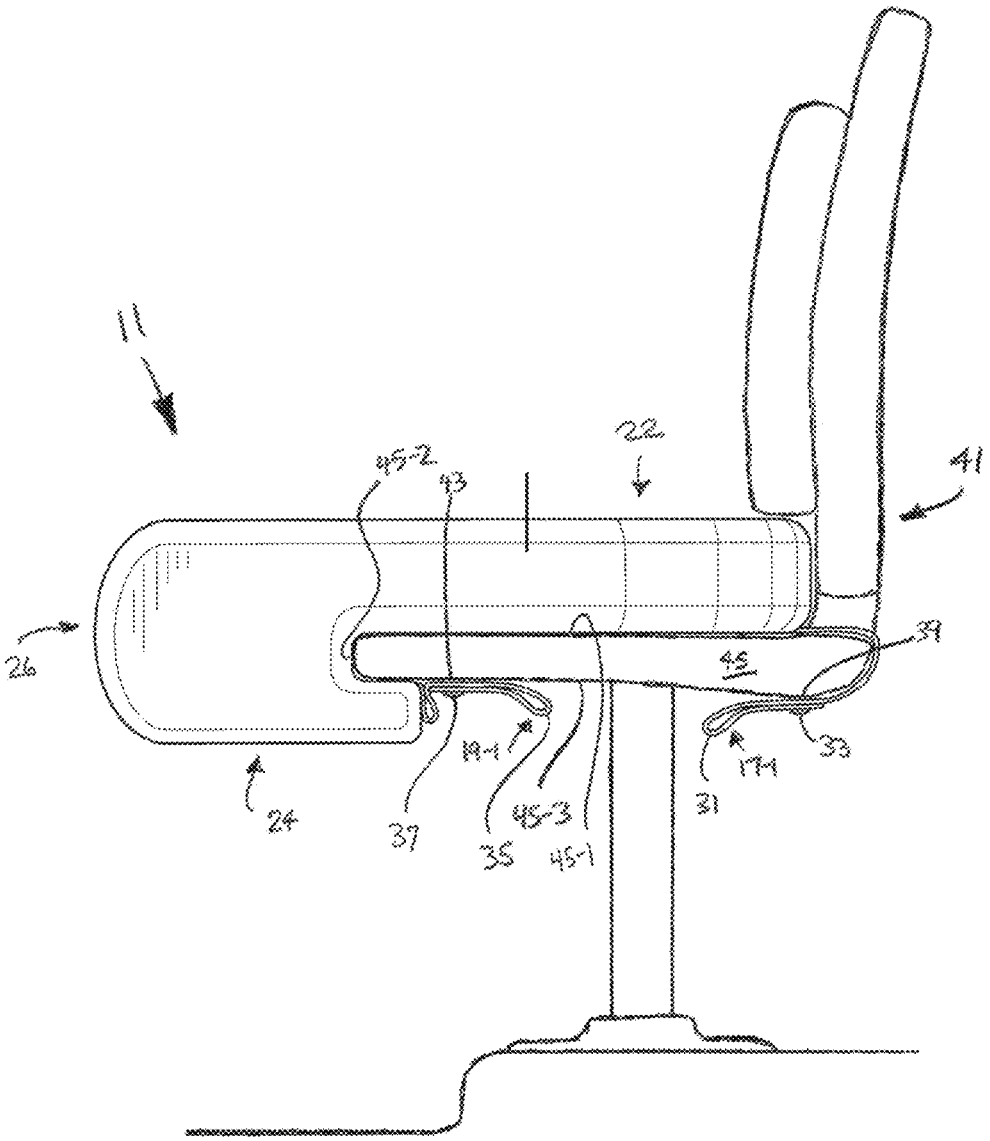
FIG. 8 is a right side view showing the cushion of FIG. 1 secured to a bucket-type boat seat.

Referring now to FIG. 8, in use, cushion 11 is mounted onto the horizontal seating portion 45 of a bucket-type seat 41 and is secured in place using snap elements 39 and 43. When installed, the top surface 45-1 of horizontal seating portion 45 may be substantially covered by the top portion 22 of cushion 11, the front surface 45-2 of horizontal seating portion 45 may be substantially covered by the front portion 26 of cushion 11, and a portion of the bottom surface 45-3 of horizontal seating portion 45 may be covered by the bottom portion 24 of cushion 11. As can be appreciated, cushion 11 must be appropriately dimensioned to receive the horizontal seating portion 45 of bucket-type seat 41. In other words, amongst other things, top portion 22 and bottom portion 24 must be appropriately spaced from one another to receive the horizontal seating portion 45 of bucket-type seat 41. Preferably, the spacing between top portion 22 and bottom portion 24 is such that horizontal seating portion 45 is snugly received between top portion 22 and bottom portion 24.

As can be seen in FIG. 8, because the front surface 45-2 of horizontal seating portion 45 is covered by cushion 11 and because the amount of impact damping material in cushion 11 that is positioned over front surface 45-2 is substantial, the above-described effects of vessel vibration and slamming may be significantly ameliorated.

In other embodiments, hook/loop fasteners or other fastening mechanisms, such as quick release straps similar to those found on personal floatation devices, may be used instead of snap fasteners.

It might be possible for future versions to include foam and plastic parts that have a carbon dioxide component. There may also be other materials that will be available in the future that have yet to be perfected or discovered that would lend themselves to this invention.

Cushion 11 can be used as a stand-alone cushion or can be used in addition to an existing or original boat seat cushion. The unique design of cushion 11 offers increased protection to both operators and passengers who are seated in typical molded plastic or composite material seats by protecting their bodies from the exposed front edge of these typical boat seats. Further, cushion 11 offers protection from the vessel vibrations and body slamming that boaters face on every trip.

Figure 9A:
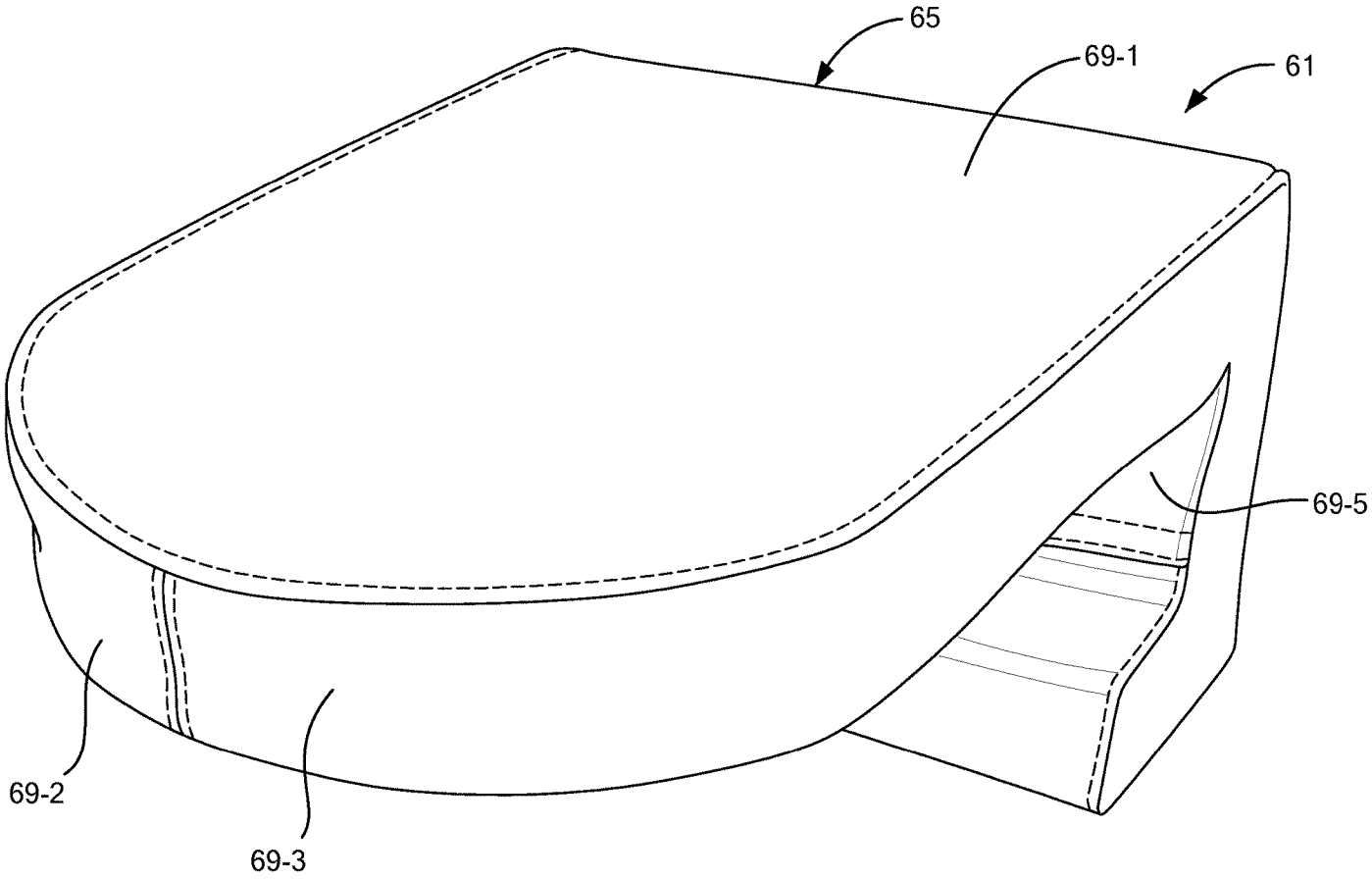
FIGS. 9(*a*) and 9(*b*) are top perspective and bottom perspective views, respectively, of a second embodiment of a cushion for use in seating for boats, the cushion being constructed according to the present invention.
Figure 9B:
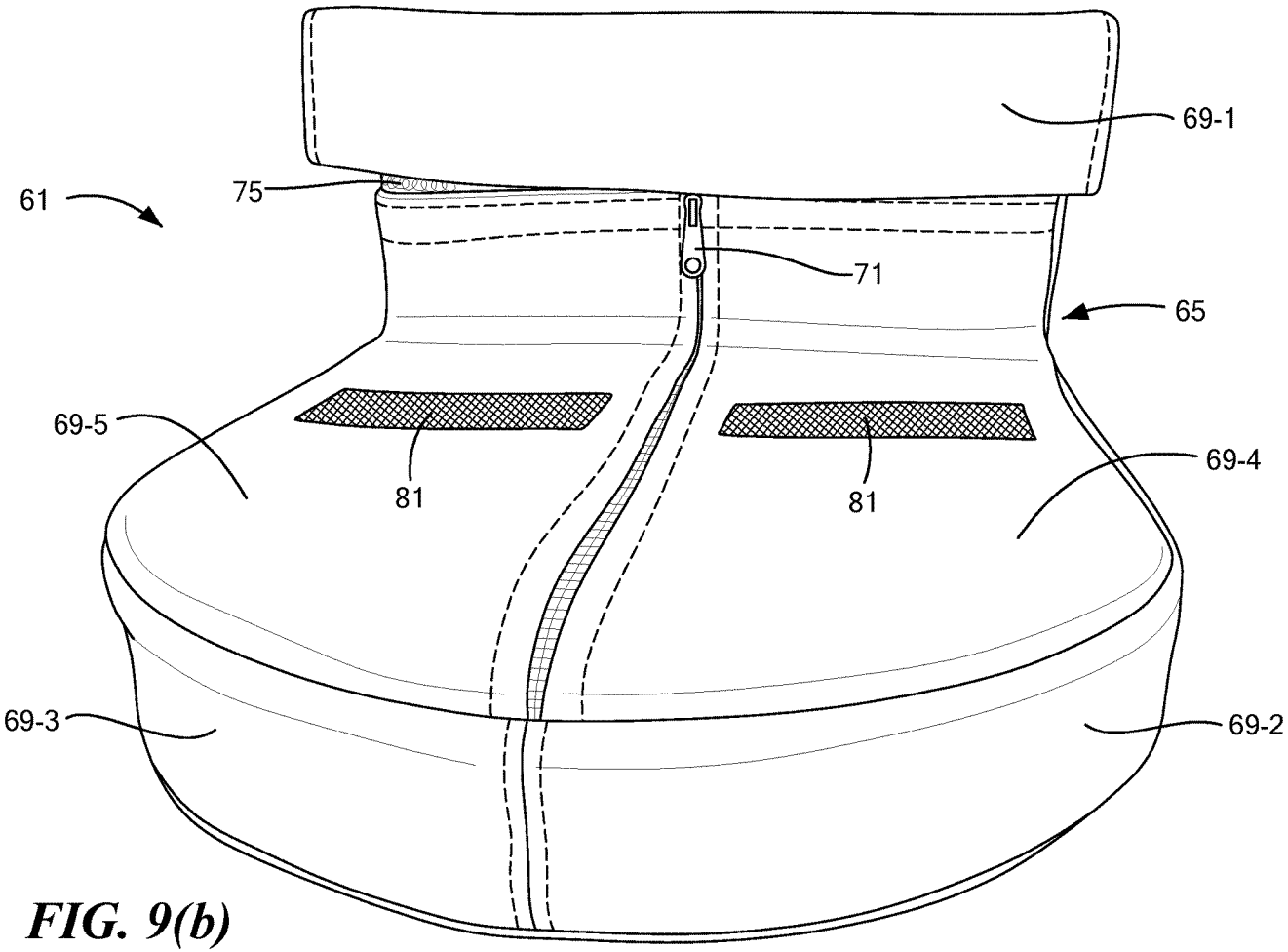
Figure 9C:
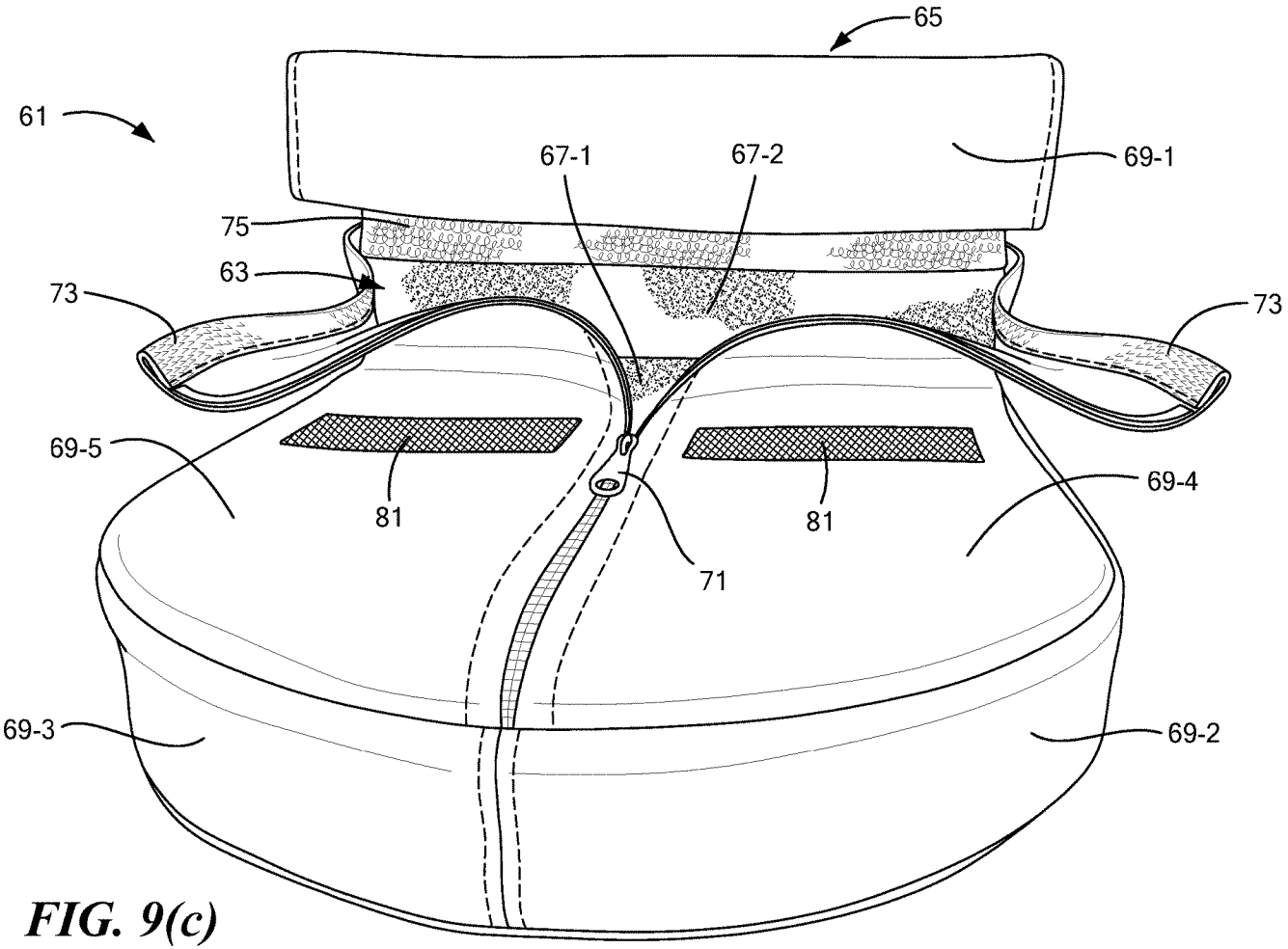

Referring now to FIGS. 9(*a*) through 9(*c*), there are shown various views of a second embodiment of a cushion constructed according to the present invention, the cushion being represented generally by reference numeral 61. Cushion 61 is specifically designed for attachment to the seat-portion of a bucket-type boating seat; however, it is to be understood that cushion 61 may have utility with other types of seats.

Cushion 61 may be similar in many respects to cushion 11. However, one difference between cushions 11 and 61 is that, whereas cushion 11 may comprise an insert 13 and a casing 15, cushion 61 may comprise an insert 63 and a casing 65.

Figure 10A:
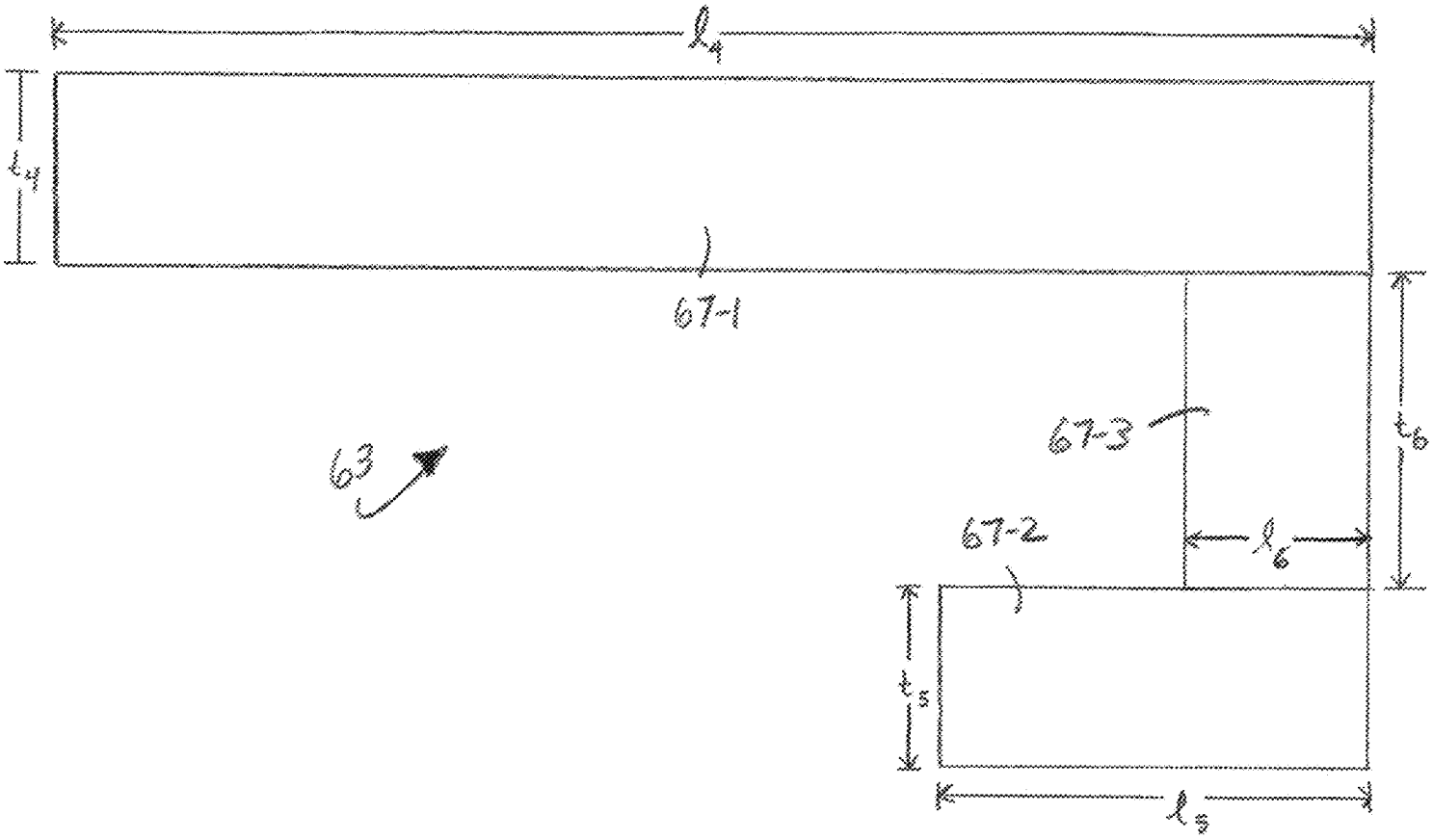
FIGS. 10(*a*) through 10(*c*) are front, side and top views, respectively, of the insert shown in FIG. 9(*c*)
Figure 10B:
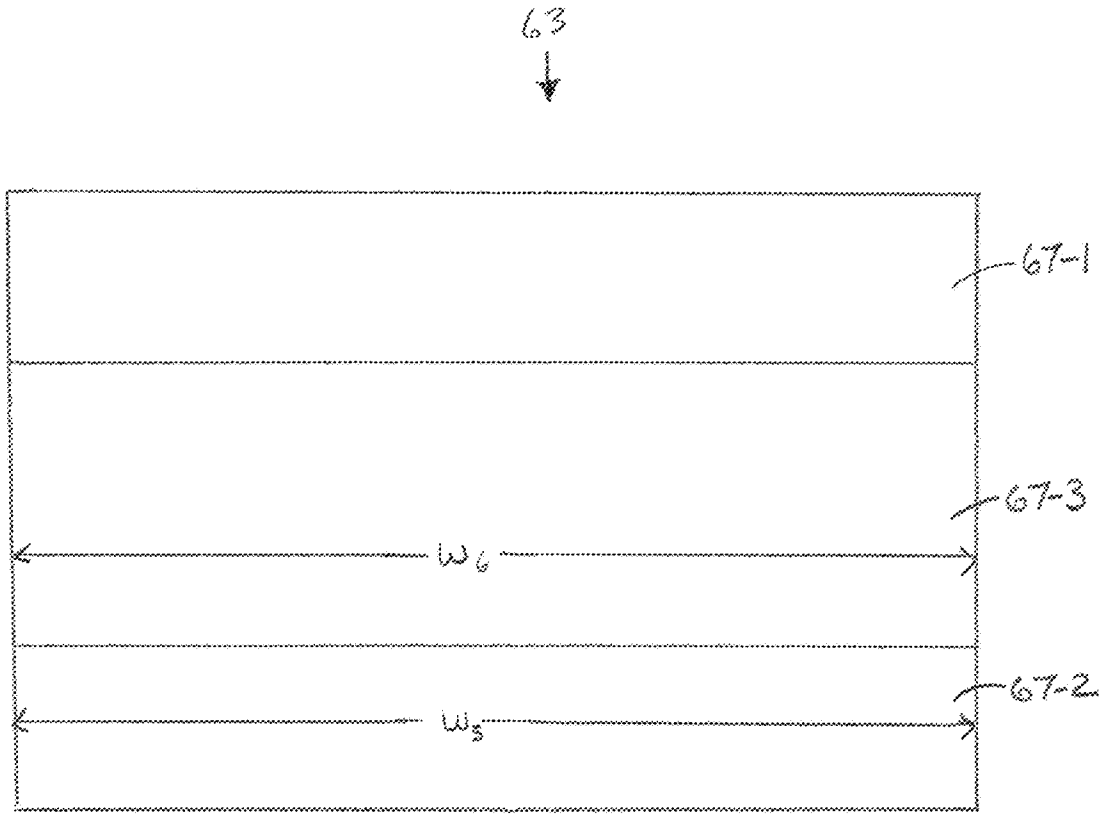
Figure 10C:
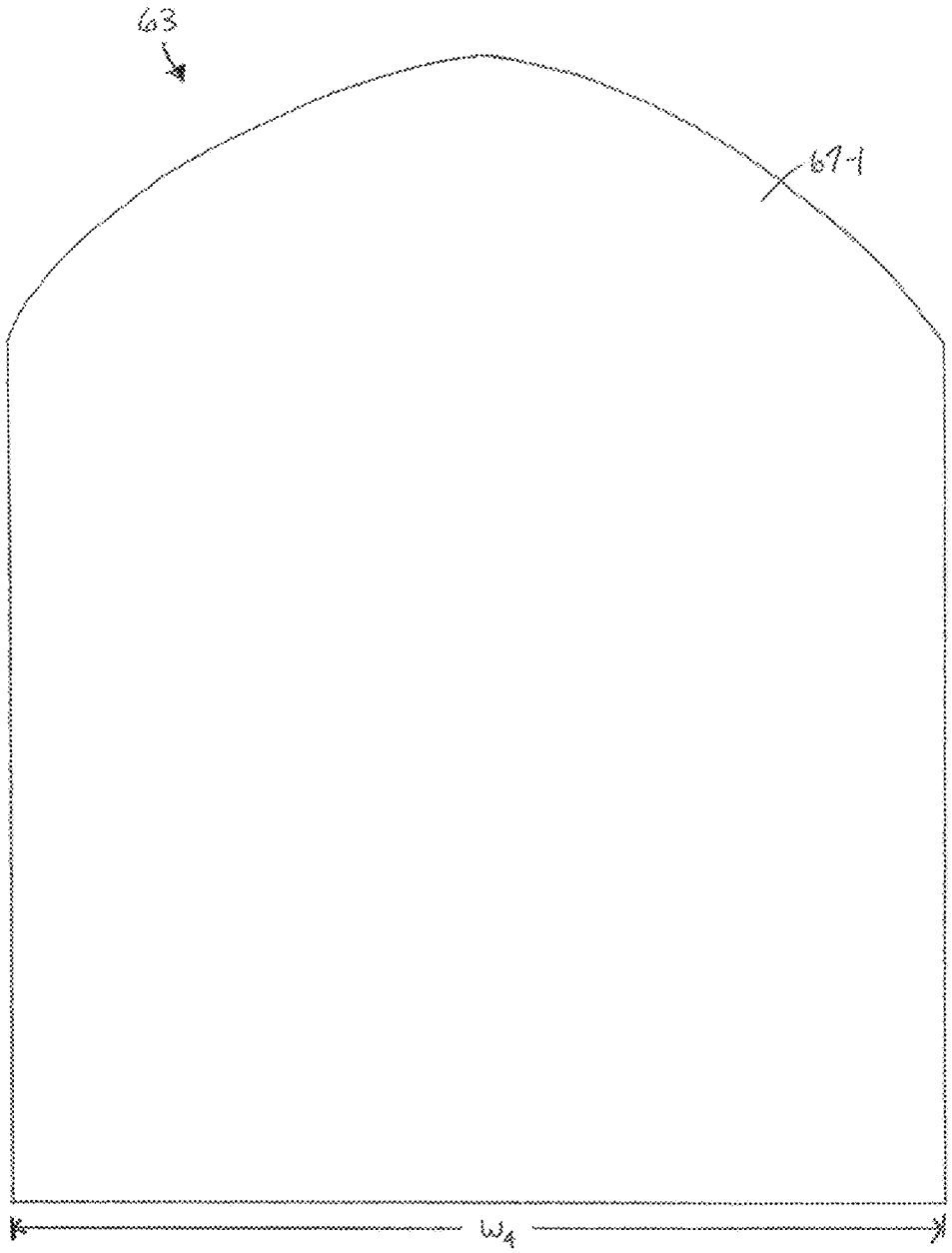
Figure 11:
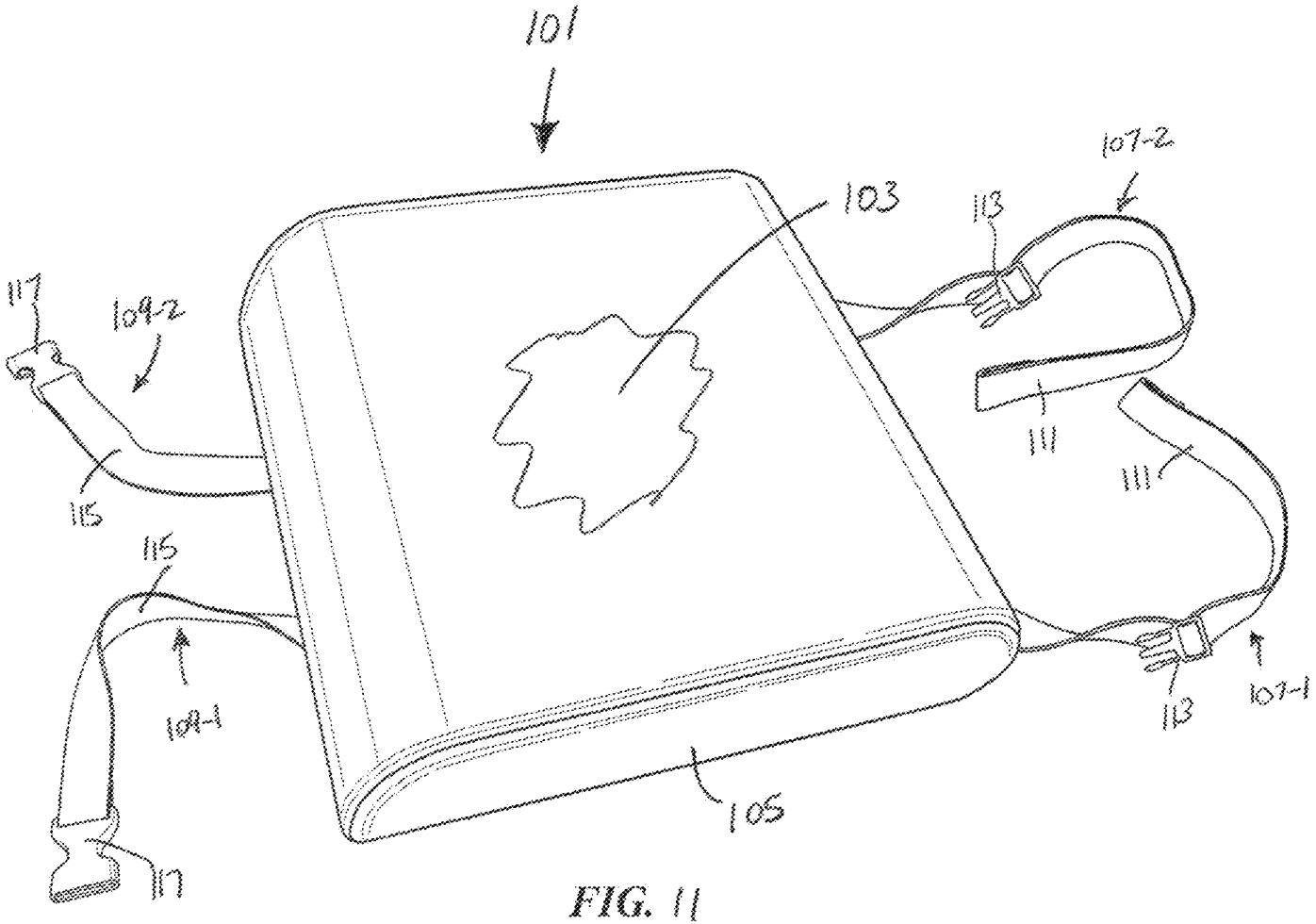
FIG. 11 is a perspective view, broken away in part, of a third embodiment of a cushion for use in seating for boats, the cushion being constructed according to the present invention.
Figure 12:
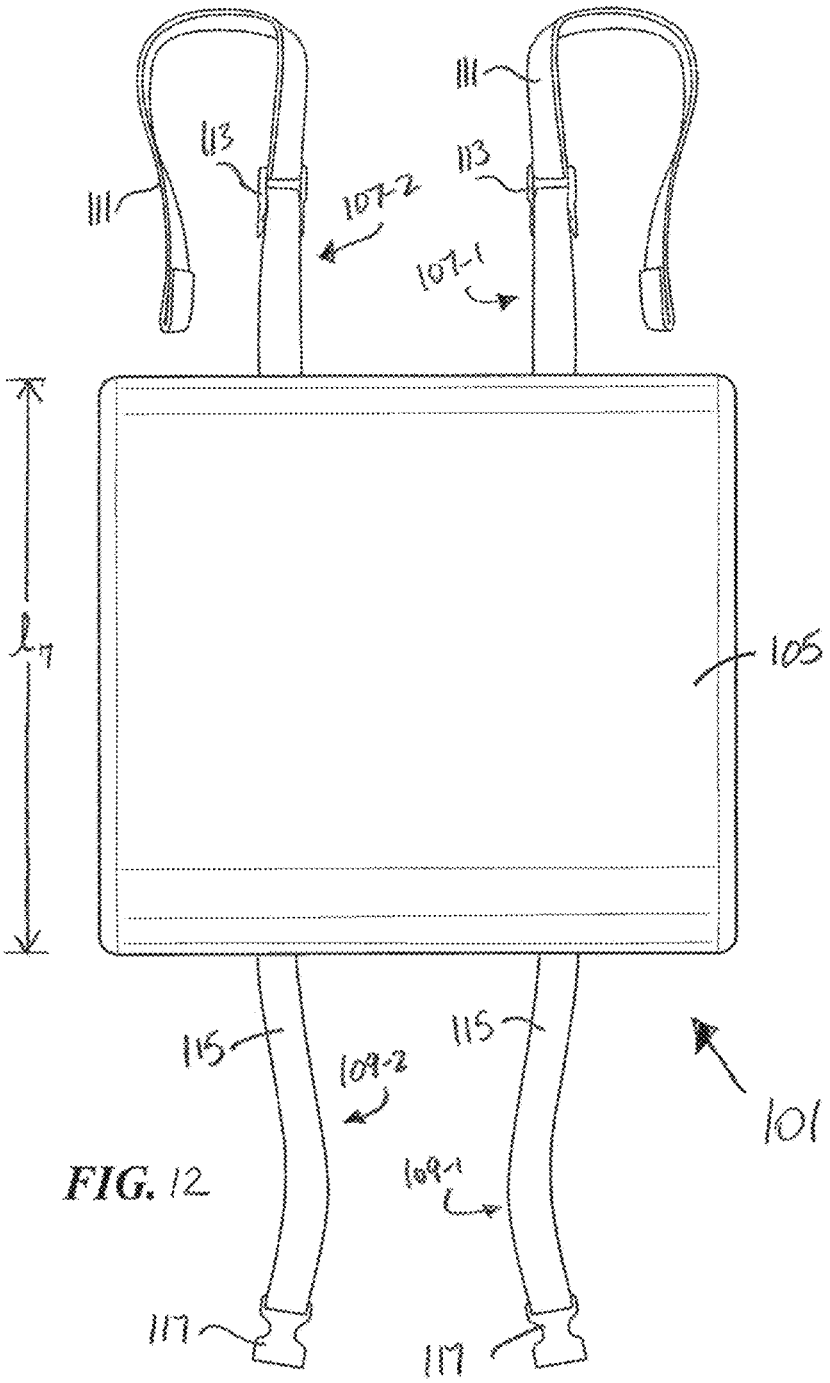
FIG. 12 is a top view of the cushion shown in FIG. 11.
Figure 13:
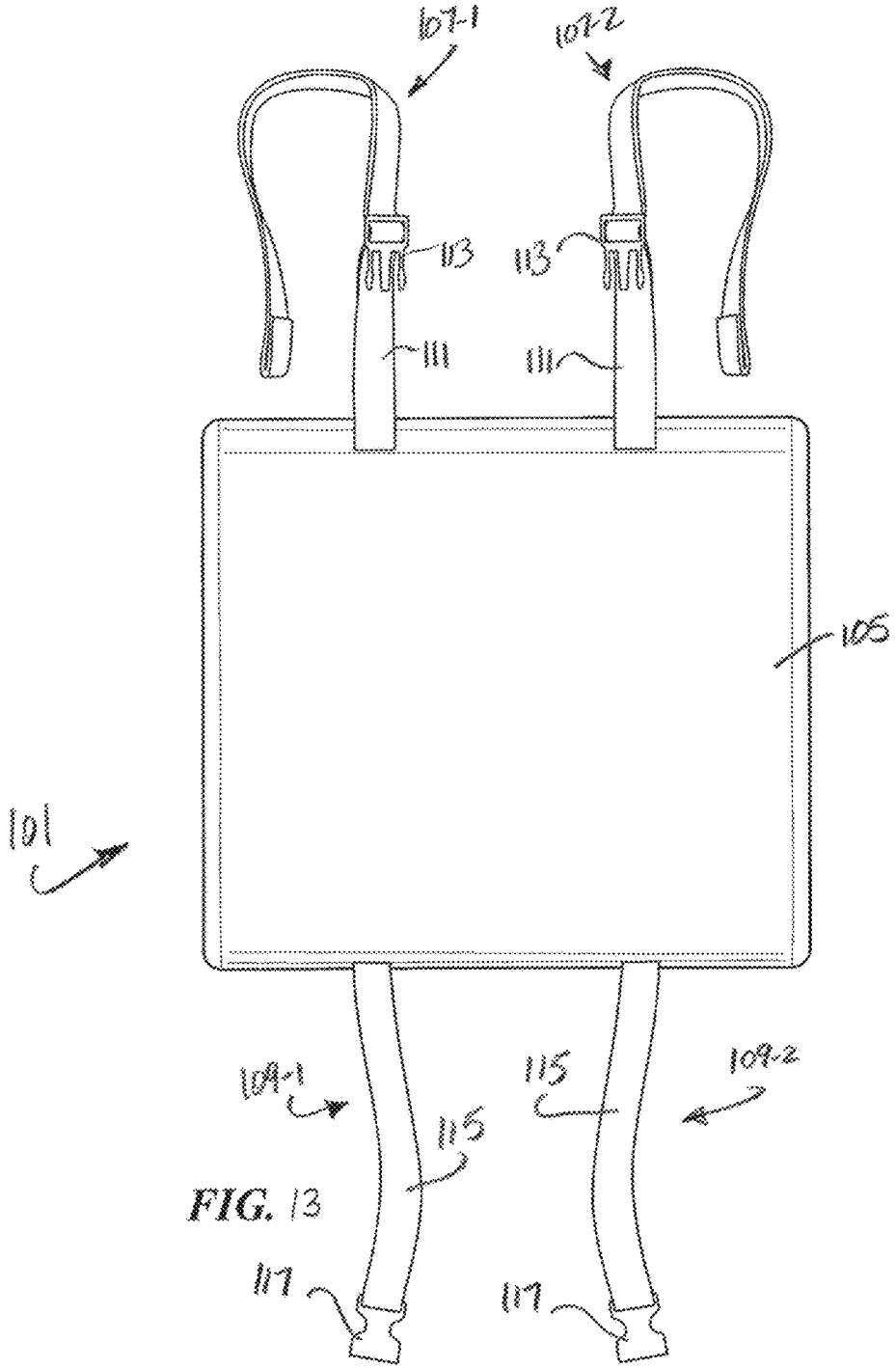
FIG. 13 is a bottom view of the cushion shown in FIG. 11.
Figure 14:
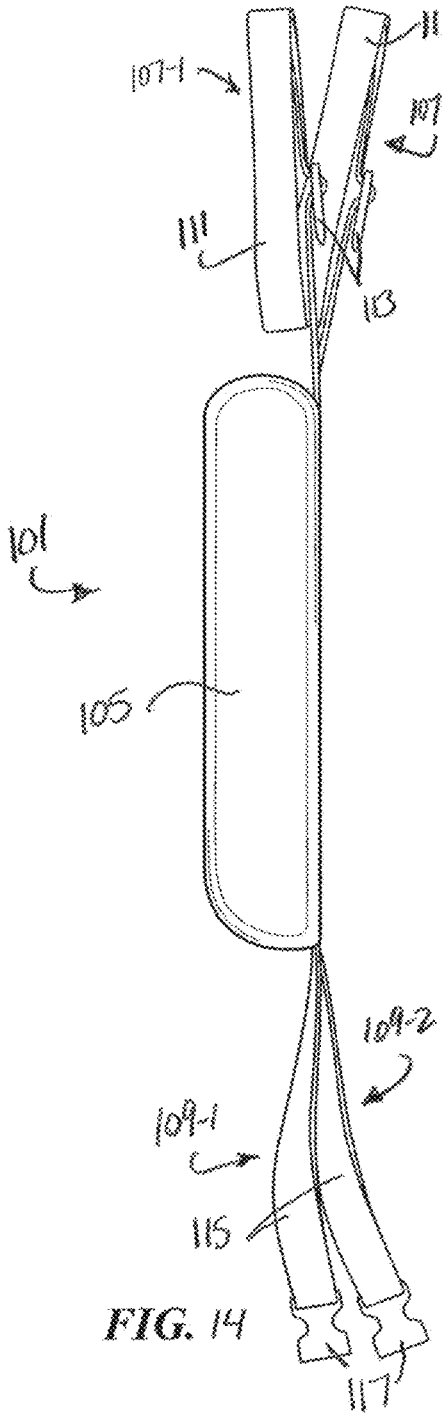
FIG. 14 is a right side view of the cushion shown in FIG. 11.
Figure 15:
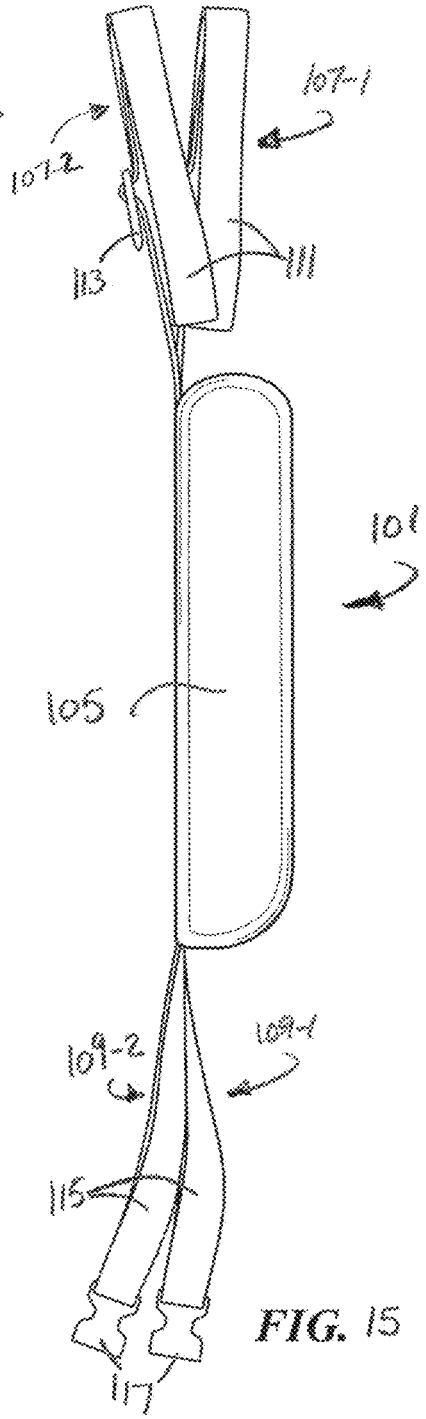
FIG. 15 is a left side view of the cushion shown in FIG. 11.
Figure 16:
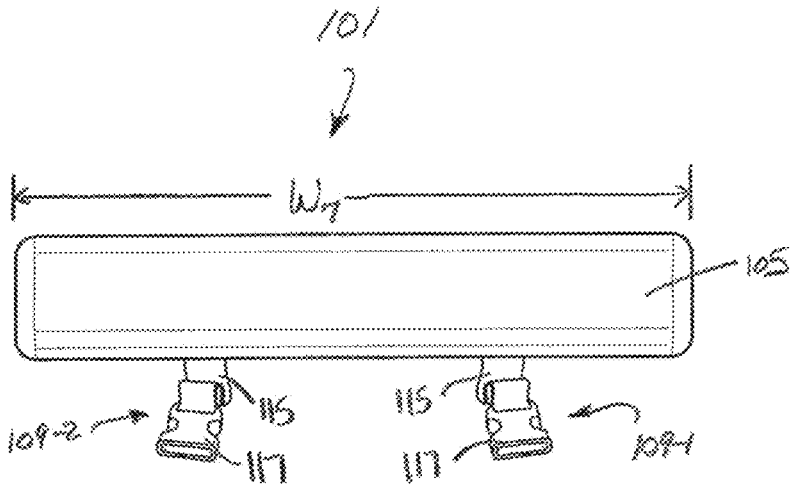
FIG. 16 is a front view of the cushion shown in FIG. 11.
Figure 17:
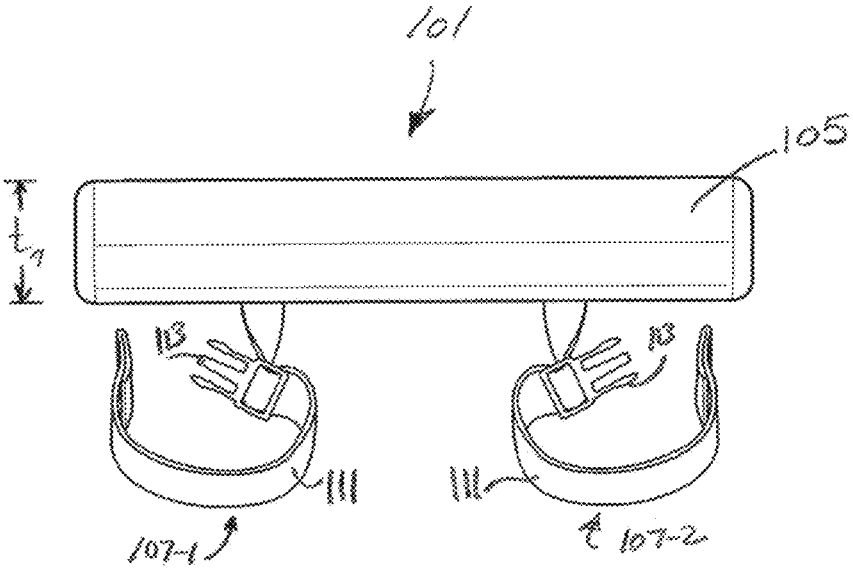
FIG. 17 is a rear view of the cushion shown in FIG. 11.

Insert 63, which is also shown separately in FIGS. 10(*a*) through 10(*c*), comprises an impact damping material and may be similar in many respects to insert 13. One difference between the two inserts may be that, whereas insert 13 may comprise a one-piece structure, insert 63 may comprise a plurality of foam pads that are joined together. In the present embodiment, insert 63 may comprise a top foam pad 67-1, a bottom foam pad 67-2, and an intermediate foam pad 67-3. The top surface of intermediate foam pad 67-3 may be joined to the bottom surface of top foam pad 67-1 by an adhesive (not shown) or other suitable means. The bottom surface of intermediate foam pad 67-3 may be joined to the top surface of bottom foam pad 67-2 by an adhesive (not shown) or other suitable means. As can be seen, top foam pad 67-1 and bottom foam pad 67-2 may be positioned generally parallel to one another and may be spaced apart by intermediate foam pad 67-3, whereby insert 63 may form a generally J-shaped structure.

One or more of foam pads 67-1 through 67-3 may be an open cell or closed cell polymer foam, such as a polyurethane foam or a polyether foam. An example of a suitable foam material for foam pads 67-1 through 67-3 may be Crest Foam polyurethane foam, which is commercially available from Crest Foam Industries, Inc., Moonachie, N.J. Another example of a suitable foam material may be a polyether foam having a foam grade of 5250, which is available as Product Code B5250CHFR0 from Crest Foam Industries, Inc., Moonachie, N.J.

Without wishing to be limited to any particular dimensions of insert 63, top foam pad 67-1 may have length $l_4$ of approximately 16 inches, a width $w_4$ of approximately 13 inches, and a thickness $t_4$ of approximately 2¼-2½ inches. Bottom foam pad 67-2 may have a length $l_5$ of approximately 5 inches, a width $w_5$ of approximately 13 inches, and a thickness $t_5$ of approximately 2¼ inches. Intermediate foam pad 67-3 may have a length $l_6$ of approximately 2¼ inches, a width $w_6$ of approximately 13 inches, and a thickness $t_6$ of approximately 3¾ inches.

Casing 65, which may be similar in many respects to casing 15, preferably conforms substantially to the shape of insert 63 and preferably covers the substantial entirety of insert 63. Casing 65, which may be made of a material that is similar to that used to make casing 15, may comprise a plurality of pieces joined to one another. In the present embodiment, casing 65 may comprise five pieces 69-1, 69-2, 69-3, 69-4 and 69-5. Piece 69-1 may be dimensioned to cover the top surface of top foam pad 67-1, the front surfaces of top foam pad 67-1, intermediate foam pad 67-3, and bottom foam pad 67-2, the bottom surface of bottom foam pad 67-2, the rear surface of bottom foam pad 67-2, the exposed portion of the top surface of bottom foam pad 67-2, and a portion of the rear surface of intermediate foam pad 67-3. Piece 69-2 may be dimensioned to cover the right side surfaces of top foam pad 67-1, intermediate foam pad 67-3, and a bottom foam pad 67-2, as well as covering a right half portion of the front of top foam pad 67-1. Piece 69-3 may be dimensioned to cover the left side surfaces of top foam pad 67-1, intermediate foam pad 67-3, and a bottom foam pad 67-2, as well as covering a left half portion of the front of top foam pad 67-1. Piece 69-4 may be dimensioned to cover a right half portion of the bottom of top foam pad 67-1, as well as a first portion of the rear surface of intermediate foam pad 67-3. Piece 69-5 may be dimensioned to cover a left half portion of the bottom of top foam pad 67-1, as well as a second portion of the rear surface of intermediate foam pad 67-3. Piece 69-1 may be stitched to each of pieces 69-2 and 69-3 at their respective adjacent edges, pieces 69-2 and 69-3 may be stitched to one another at their respective adjacent edges, pieces 69-2 and 69-4 may be stitched to one another at their respective adjacent edges, and pieces 69-3 and 69-5 may be stitched to one another at their respective adjacent edges. Pieces 69-4 and 69-5 may be repeatedly joined to one another and then separated from one another at their respective adjacent edges by a zipper 71, and each of pieces 69-4 and 69-5 may be repeatedly joined to and then separated from piece 69-1 at their respective adjacent edges by complementary strips of hook and loop fasteners. For example, strips of hook fasteners 73 may be detachably secured to the inner faces of each of pieces 69-4 and 69-5, and a strip of loop fasteners 75 may be detachably secured to the outer face of piece 69-1. The provision of zipper 71, hook fasteners 73 and loop fasteners 75 may facilitate the insertion of insert 63 into casing 65 and, if needed, the removal of insert 63 from casing 65.

Yet another difference between cushions 61 and 11 is that, whereas cushion 11 comprises fastening mechanisms 17-1, 17-2, 19-1 and 19-2, cushion 61 does not comprise fastening mechanisms 17-1, 17-2, 19-1, 19-2; instead, cushion 61 may comprise one or more strips of hook/loop fasteners 81 secured to the bottom surface of the top portion of casing 15, and one or more complementary strips of hook/loop fasteners may be secured to the top of the horizontal seating portion of the bucket-type seat.

Except as otherwise described, cushion 61 may be used in a generally similar fashion as cushion 11. If desired, cushion 61 may be dimensioned to snugly receive the horizontal seating portion of the bucket-type seat to which it is attached. Like cushion 11, cushion 61 can be used as a stand-alone cushion or can be used in addition to an existing or original boat seat cushion.

Referring now to FIGS. 11 through 17, there are shown various views of a third embodiment of a cushion constructed according to the teachings of the present invention, the cushion being represented generally by reference numeral 101.

Cushion 101, which is designed to be attached to the bolster of a bolster-type boating seat, may comprise an insert 103, a casing 105, a plurality of rearward-facing fastening mechanisms 107-1 and 107-2, and a plurality of forward-facing fastening mechanisms 109-1 and 109-2.

Insert 103 comprises an impact damping material and may comprise, for example, a foam pad or a plurality of discrete foam pads. (Alternatively, insert 103 may comprise a material other than one or more foam pads.) The foam pad or plurality of discrete foam pads of insert 103 each may comprise a unitary foam piece or may comprise a plurality of foam pieces of similar or dissimilar composition joined to one another by adhesive or other suitable means. Preferably, insert 103 exhibits the resilience and compressibility of a closed cell foam with a foam industry typical description ranging from 2-24 to 2-30, with 2-27 being particularly preferred. Lighter grades of foam may be used but are less preferred. Insert 103 preferably has a generally rectangular prismatic shape.

Casing 105 preferably conforms substantially to the shape of insert 103 and preferably covers the substantial entirety of insert 103. Casing 105 may be a generally flexible, thin-walled, protective material and may comprise any of a variety of different materials including, but not limited to, marine-grade vinyl using industry specifications of 22 ounce to 30 ounce material. Lesser quality vinyl could also be used but is less preferred in terms of resistance to wear and tear. SUNBRELLA® fabric, medium weight NYLON® polyamide, and any water-resistant polyvinyl chloride (PVC) material may also be used for the casing. Large sheets of plastic or canvas may be cut and trimmed to fit around the insert as well. Casing 105 may be stitched with the stitching appearing on the inside seams and not visible on the outside. Casing 105 may also be stitched on the outside seams using a decorative "bead" to hide the actual seams. It is also possible to "glue" the seams together, or tape the seams together, but the use of glue or tape does not offer the security or the finish quality that stitching offers. Every external surface of insert 103 is preferably covered by the casing material.

Without wishing to be limited to any particular dimensions, insert 103 and casing 105 may collectively have a generally rectangular prismatic shape and may have a length $l_7$ of approximately 16 inches, a width $w_7$ of approximately 16 inches, and a thickness $t_7$ of approximately 1.5 to 3 inches (which may vary depending on the type of foam used).

Rearward-facing fastening mechanisms 107-1 and 107-2 may be secured by stitching or other suitable means to the rear of casing 105, and forward-facing fastening mechanisms 109-1 and 109-2 may be secured by stitching or other suitable means to the front of casing 105. In the present embodiment, fastening mechanisms 107-1 and 107-2 each may comprise a flexible strap 111 having a male element 113 of a quick release fastener proximate to the free end thereof, and fastening mechanisms 109-1 and 109-2 each may comprise a flexible strap 115 having a female element 117 of a quick release fastener proximate to the free end thereof. Male elements 113 and female elements 117 are designed to mate with one another in the conventional fashion. In this manner, cushion 101 may be secured to a bolster 121 (see FIGS. 18 and 19). Straps 111 and/or 115 may have a length that is adjustable for accommodating differently dimensioned bolsters.

It should be understood that, instead of using quick release straps as in the present embodiment, one could alternatively use, for example, ½ to 1 inch complementary hook and loop fasteners or other fastening mechanisms to attach the cushion to the bolster.

To assemble cushion 101, an insert as described above is first provided. Although a pivoting bolster typically extends the full width of its corresponding seat, it is generally not necessary to protect the outer 2-3 inches of the bolster itself. The reason is that the seat occupant will typically sit in the center of the bolster, not to the extreme edges/ends. The pivoting bolster typically has measurements, as viewed from an end of bolster, of either approximately 7 inches×7 inches or approximately 8 inches×8 inches. The foam insert is preferably cut to fit either measurement noted above. Next, a covering material, as previously mentioned, is cut so that it has sufficient length and width to cover the foam insert and overlap the vertical (height) surfaces, approximately 2 inches. At this point, the covering material typically covers all sides of the foam insert, except for the bottom surface. Next, the covering material is cut to a sufficient dimension so that the bottom of the insert is covered but allowing enough extra fabric so that the upper and lower covering materials, the shell, can be stitched. At this point, the two quick release straps are sewn/stitched securely, or otherwise attached, to the inner surface of the top side cover. Upon completion of that step, the foam insert is placed onto the just stitched cover and strap and the bottom piece of the shell. The cover is then stitched to the top/upper cover. Just before the entire cover is totally stitched, the foam insert is inserted into the casing that has just been crafted and then the final stitching is completed. The stitching can all be done on the interior of the casing so as to not be visible or the stitching may be done on the outside of the cushion and finished off with a decorative "bead" that will hide the stitching.

Figure 18:
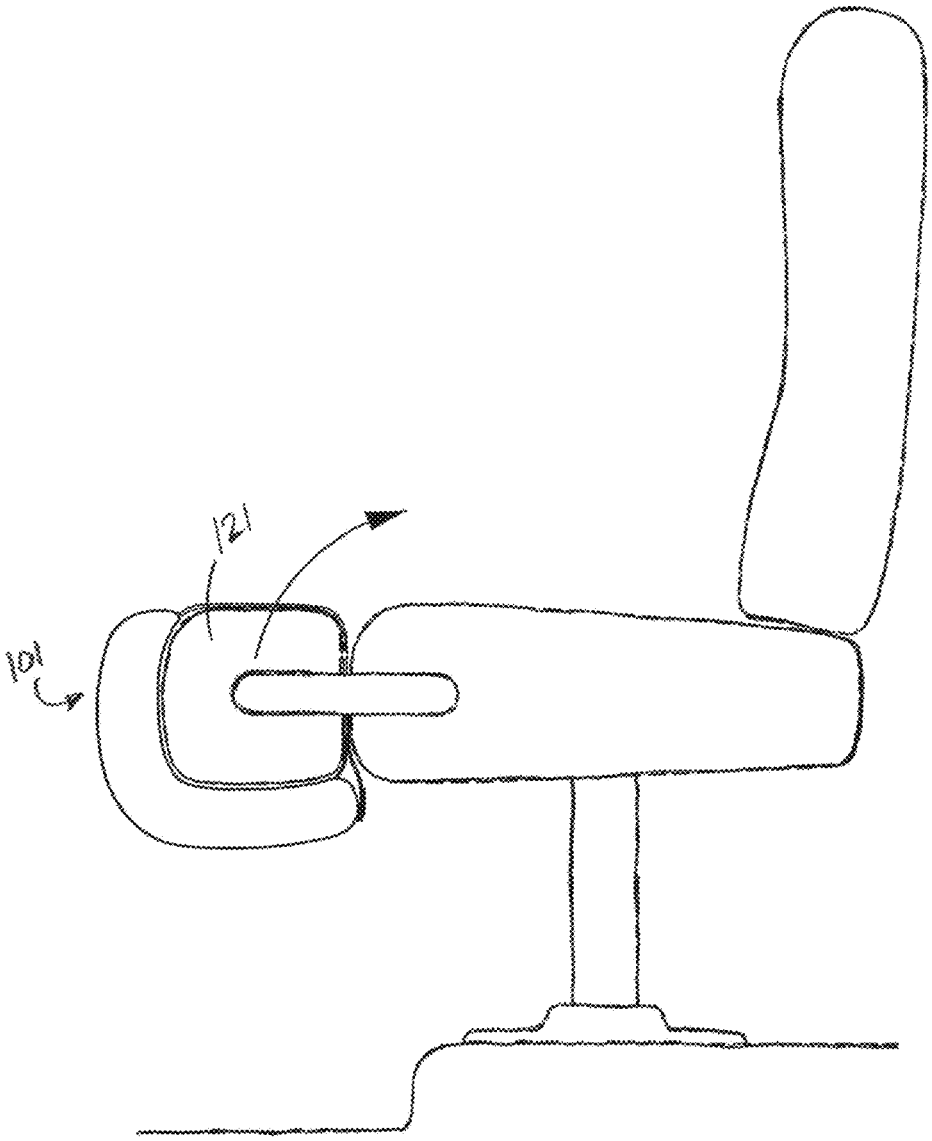
FIG. 18 is a right side view showing the cushion of FIG. 11 secured to a pivotable bolster of a boat seat, the pivotal bolster being shown in a lowered position.
Figure 19:
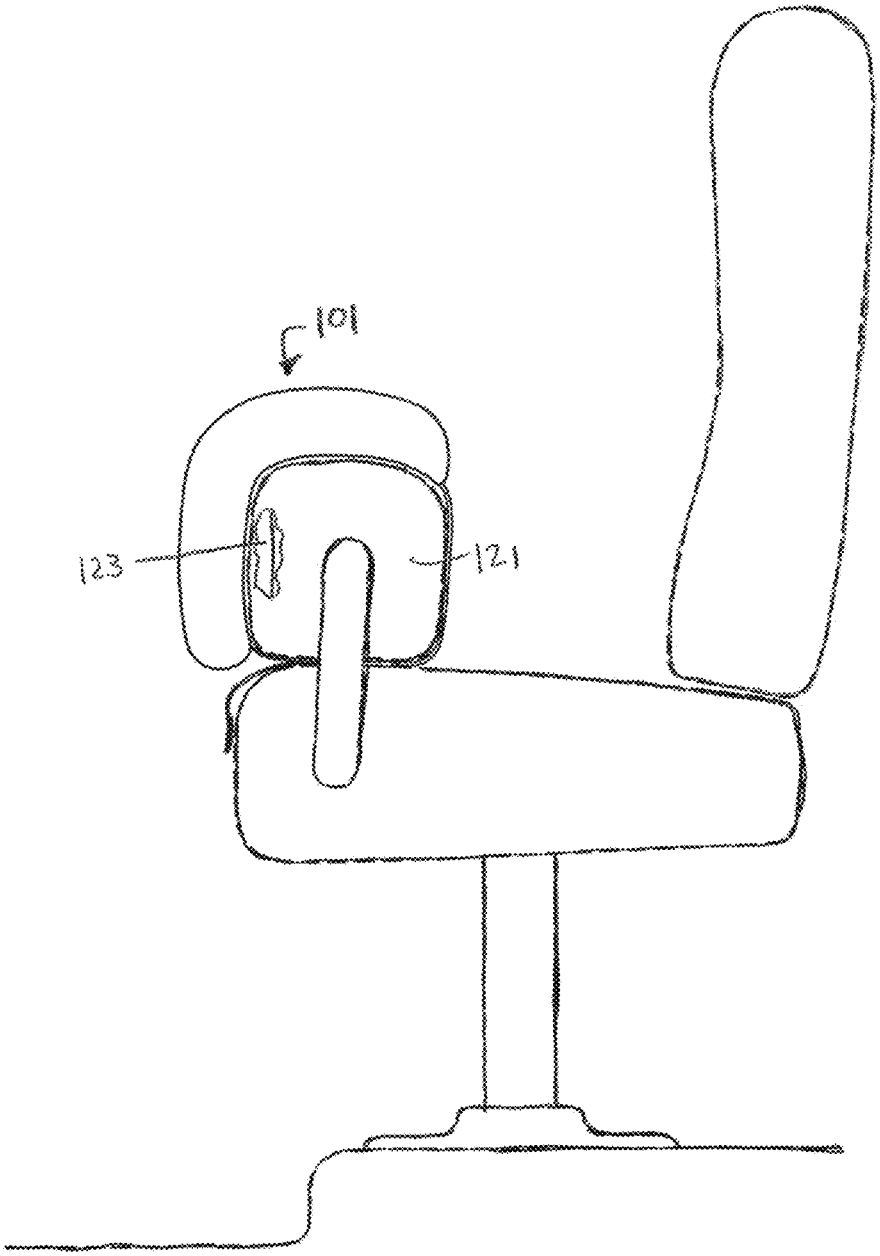
FIG. 19 is a right side view, broken away in part, showing the cushion of FIG. 11 secured to a pivotable bolster of a boat seat, the pivotal bolster being shown in a raised position.

Referring now to FIGS. 18 and 19, the use of cushion 101 on bolster 121 can be seen. As seen best in FIG. 19, when bolster 121 is moved to its "up" position, cushion 101 offers protection to the user from the encased plywood "frame" 123 of the bolster 121, which is now positioned at the front of the bolster 121.

To improve the contour of the cushion as it is wrapped around the upper and vertical surfaces of the bolster, a side to side notch may be provided in the underside of the foam, such a notch improving the fit of the cushion to the 90 degree turn at the corner of the bolster.

Figure 20A:
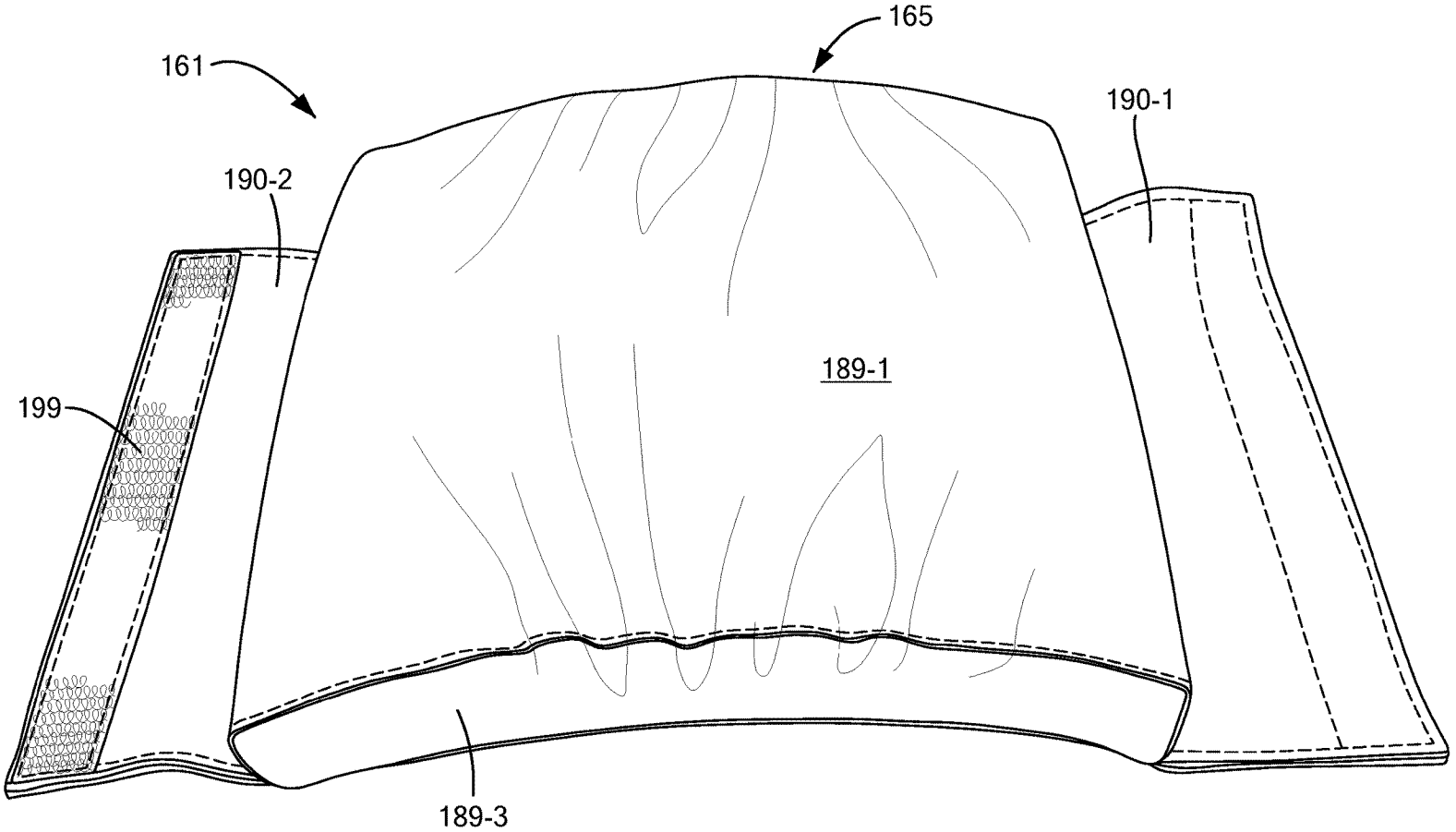
FIGS. 20(*a*) and 20(*b*) are top perspective and bottom perspective views, respectively, of a fourth embodiment of a cushion for use in seating for boats, the cushion being constructed according to the present invention.
Figure 20B:
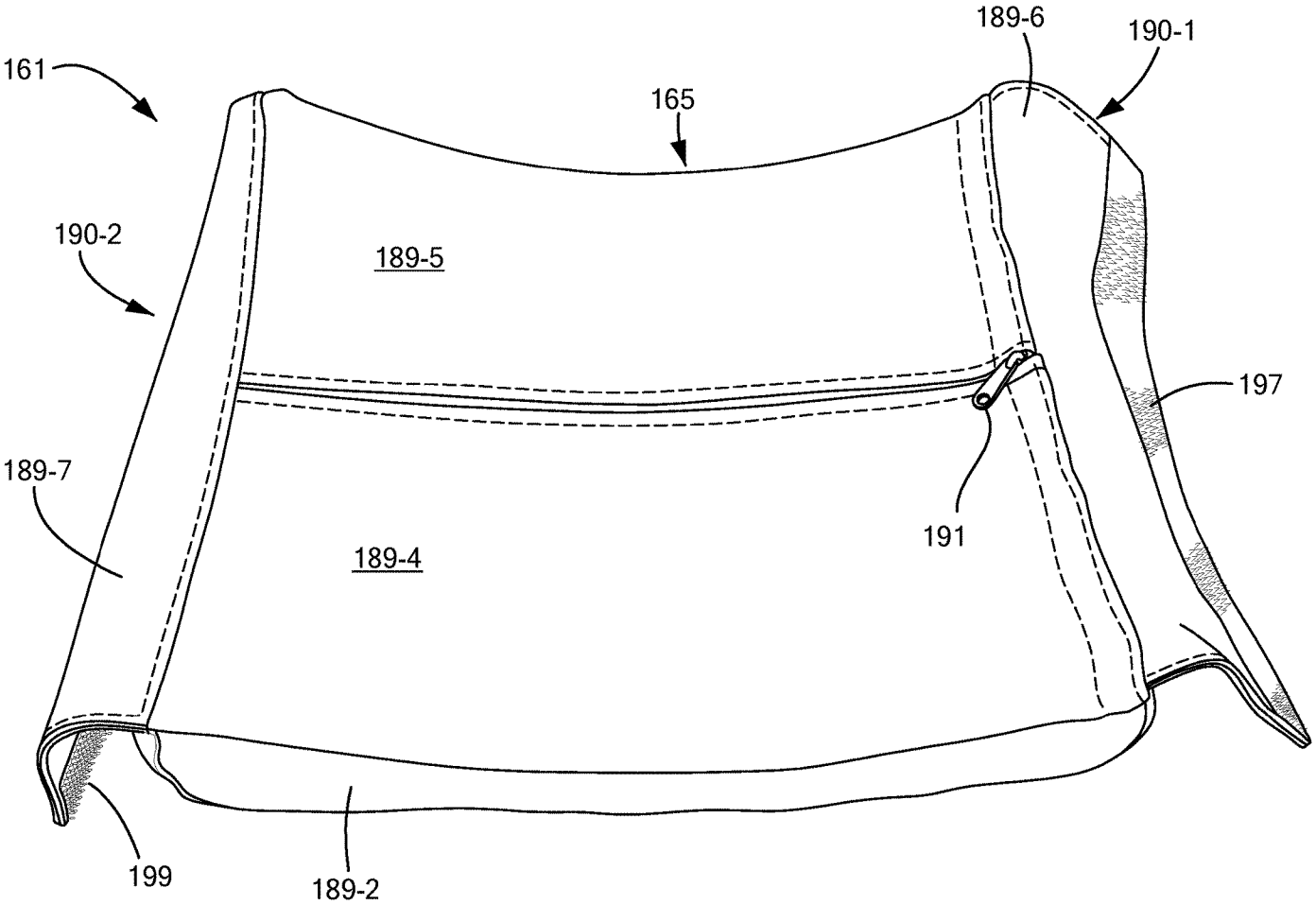
Figure 20C:
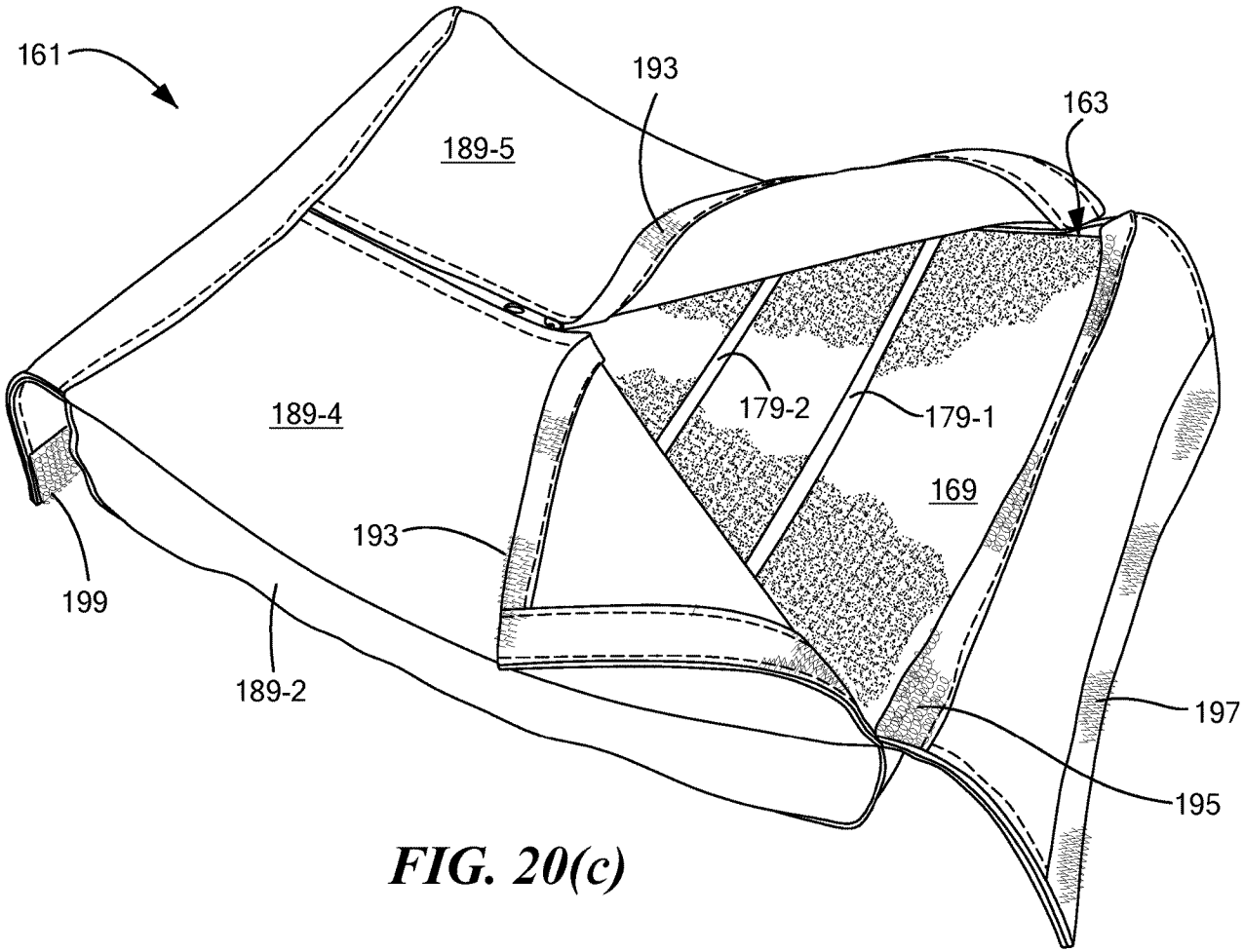

Referring now to FIGS. 20(*a*) through 20(*c*), there are shown various views of a fourth embodiment of a cushion constructed according to the present invention, the cushion being represented generally by reference numeral 161. Cushion 161 is specifically designed for attachment to a bolster of a bolster-type boating seat; however, it is to be understood that cushion 161 may have utility with other types of seats.

Cushion 161 may be similar in many respects to cushion 101. However, one difference between cushions 161 and 101 is that, whereas cushion 101 may comprise an insert 103 and a casing 105, cushion 161 may comprise an insert 163 and a casing 165.

Figure 21A:
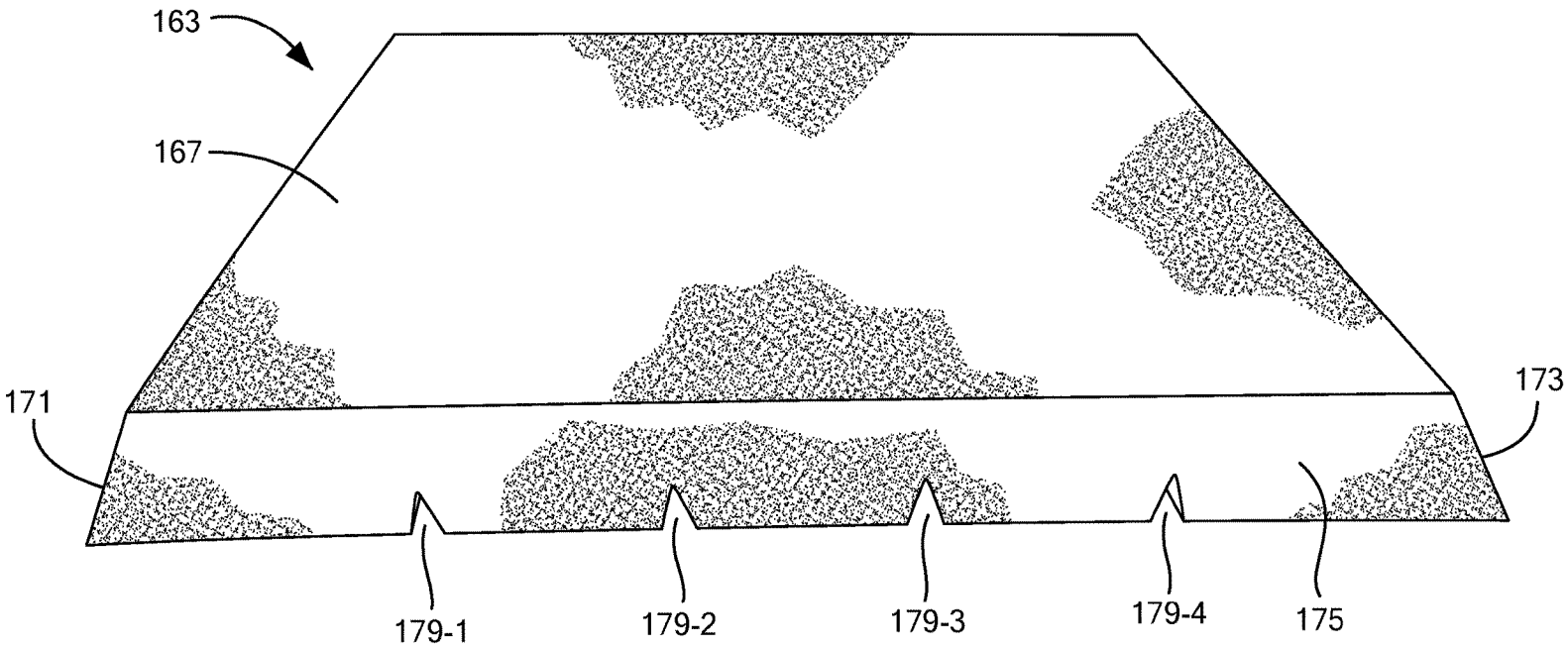
FIGS. 21(*a*) and 21(*b*) are top perspective and bottom perspective views, respectively, of the insert shown in FIG. 20(*c*)
Figure 21B:
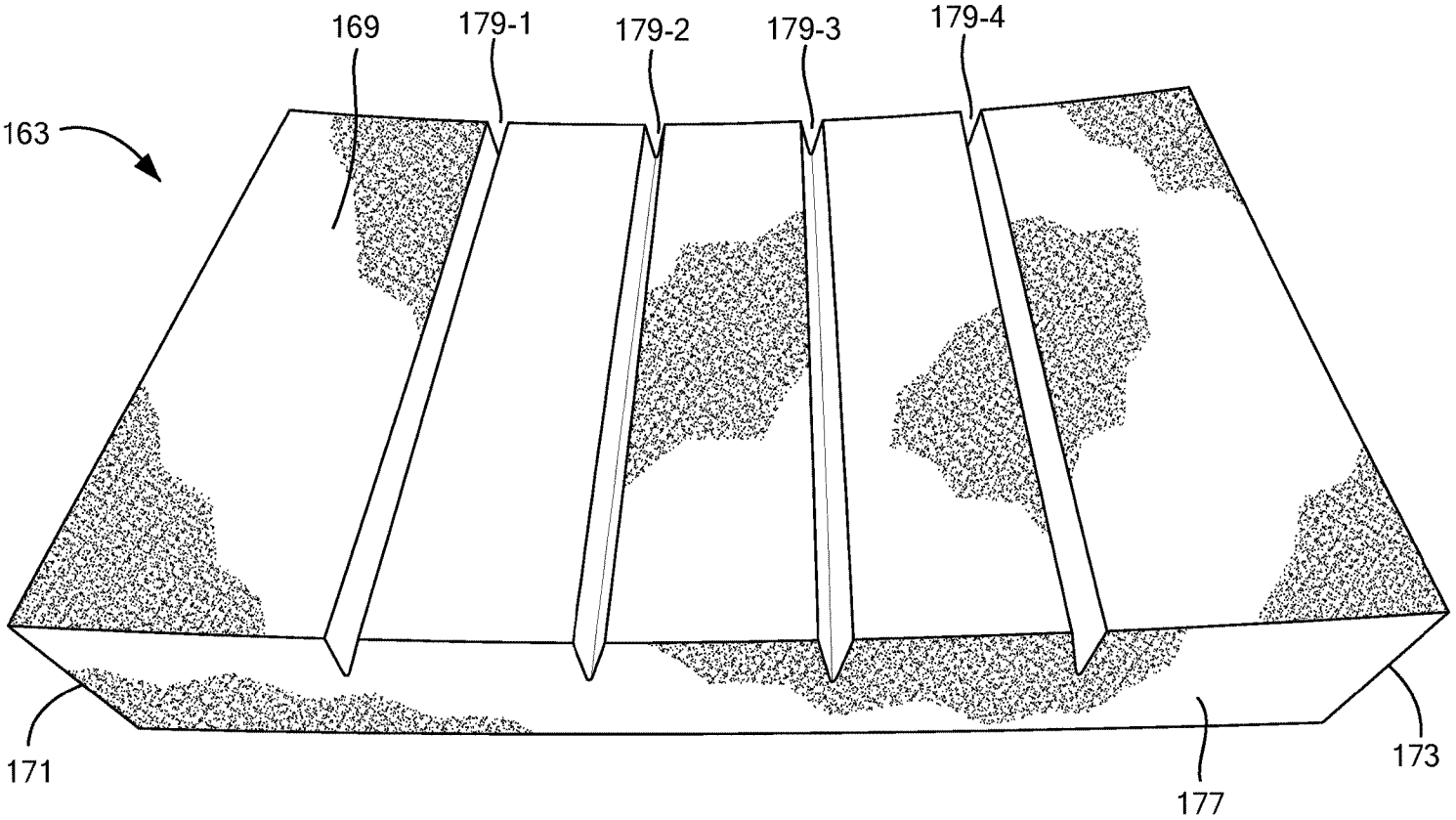

Insert 163, which is also shown separately in FIGS. 21(*a*) and 21(*b*), comprises an impact damping material. In the present embodiment, insert 163 may comprise a one-piece foam pad, which may be an open cell or closed cell polymer foam, such as a polyurethane foam or a polyether foam. An example of a suitable foam material for insert 163 may be Crest Foam polyurethane foam, which is commercially available from Crest Foam Industries, Inc., Moonachie, N.J. Another example of a suitable foam material may be a polyether foam having a foam grade of 5250, which is available as Product Code B5250CHFR0 from Crest Foam Industries, Inc., Moonachie, N.J.

Insert 163, which may have a generally trapezoidal prismatic shape, may include a top 167, a bottom 169, a front 171, a rear 173, a left side 175, and a right side 177. A plurality of notches 179-1 through 179-4, which may be similarly shaped and dimensioned to one another and which are preferably V-shaped in transverse cross-section, may be provided along bottom 169, notches 179-1 through 179-4 helping to permit insert 163 to be bent so that front 171 and rear 173 may be drawn towards one another. Notches 179-1 through 179-4 may extend from left side 175 to right side 177 and may extend partially from bottom 169 towards top 167. Although four notches 179 are shown in the present embodiment, it is to be understood that the number of notches 179 may be greater than four or less than four.

Without wishing to be limited to any particular dimensions of insert 163, top 167 may have a length of approximately 18.5 inches, bottom 169 may have a length of approximately 20.75 inches, the distance from left side 175 to right side 177 may be approximately 16.25 inches, the distance from top 167 to bottom 169 may be approximately 2.25 inches, notches 179-1 through 179-4 each may have a depth of approximately ¾ inch, notches 179-1 through 179-4 may be spaced apart from one another by approximately 3 inches, the distance from front 171 to notch 179-1 may be approximately 4.5 inches, and the distance from rear 173 to notch 179-4 may be approximately 4.5 inches.

Casing 165, which may be similar in many respects to casing 105, preferably conforms substantially to the shape of insert 163 and preferably covers the substantial entirety of insert 163. Casing 165, which may be made of a material that is similar to that used to make casing 105, may comprise a plurality of pieces joined to one another. In the present embodiment, casing 165 may comprise seven pieces 189-1, 189-2, 189-3, 189-4, 189-5, 189-6, and 189-7.

Piece 189-1 may be dimensioned to cover the top 167 of insert 163 and may extend beyond front 171 of insert 163 to define a front flap portion 190-1 and also may extend beyond rear 173 of insert 163 to define a rear flap portion 190-2. Piece 189-2 may be dimensioned to cover the left side 175 of insert 163, and piece 189-3 may be dimensioned to cover the right side 177 of insert 163. Piece 189-4 may be dimensioned to cover a left half portion of insert 163, and piece 189-5 may be dimensioned to cover a right half portion of insert 163.

Piece 189-1 may be stitched to each of pieces 189-2 and 189-3 at their respective adjacent edges. Piece 189-2 may be stitched to piece 189-4 at their respective adjacent edges, and piece 189-3 may be stitched to piece 189-5 at their respective adjacent edges. Pieces 189-4 and 189-5 may be repeatedly joined to one another and separated from one another at their respective adjacent edges by a zipper 191. One end of each of pieces 189-4 and 189-5 may be stitched to piece 189-1, and the opposite end of each of pieces 189-4 and 189-5 may be repeatedly joined to and separated from piece 189-1 at their respective adjacent edges by complementary strips of hook and loop fasteners. For example, strips of hook fasteners 193 may be detachably secured to the inner faces of each of pieces 189-4 and 189-5, and a strip of loop fasteners 195 may be detachably secured to the outer bottom face of piece 189-1. The provision of zipper 191, hook fasteners 193 and loop fasteners 195 may facilitate the insertion of insert 163 into casing 165 and, if needed, the removal of insert 163 from casing 165. If desired, the pocket defined by casing 165 may be slightly undersized in length relative to insert 163 so that insert 163 assumes an arcuate shape when disposed within casing 165.

Figure 22:
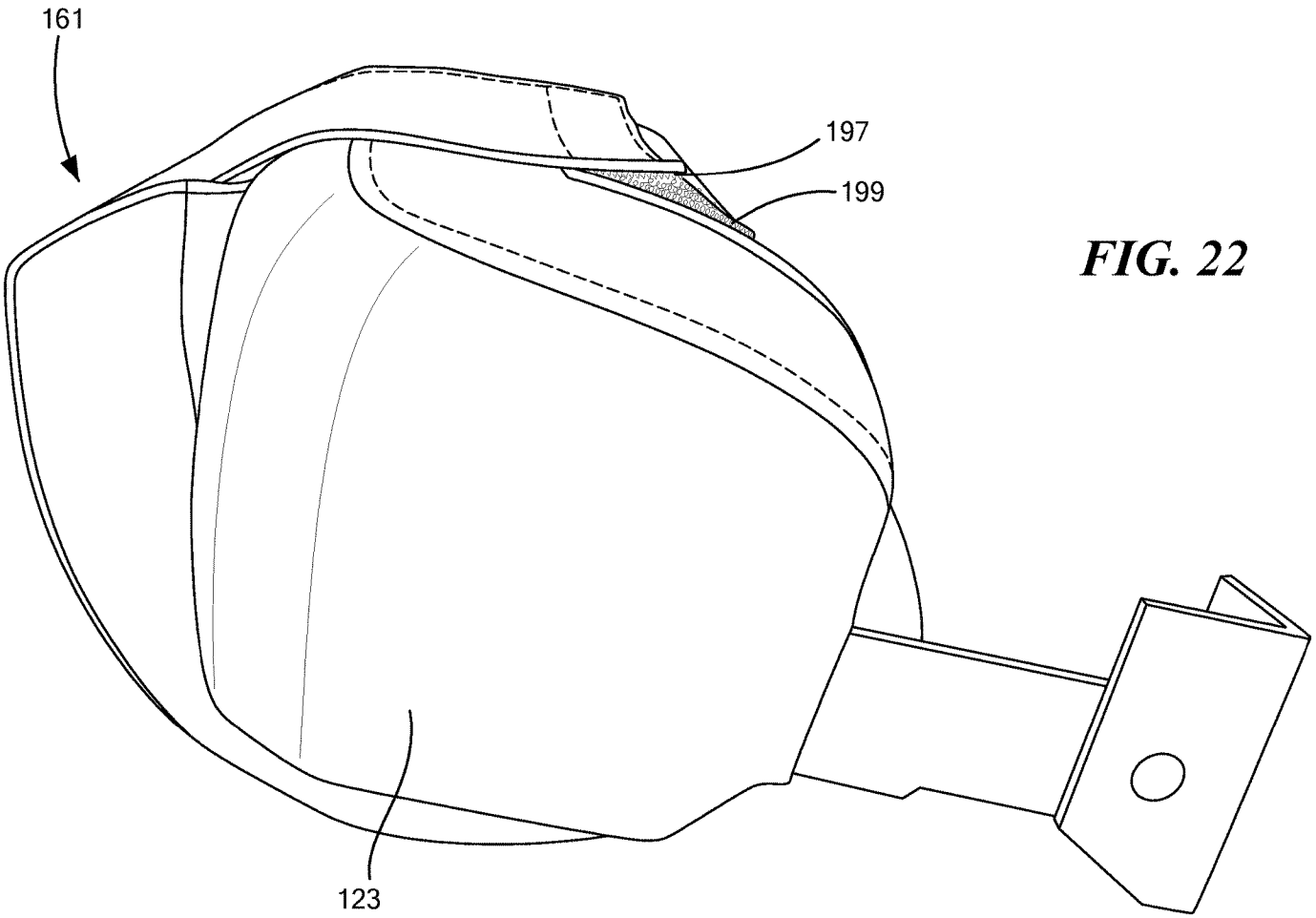
FIG. 22 is a side view showing the cushion of FIG. 20(*a*) secured to a pivotable bolster of a boat seat (the boat seat not being shown).

Piece 189-6 may be stitched to the bottom of front flap portion 190-1, and piece 189-7 may be stitched to the bottom of front flap portion 190-2. A strip of hook fasteners 197 may be stitched or otherwise secured to the bottom of piece 189-6, and a strip of complementary loop fasteners 199 may be stitched or otherwise secured to the top of rear flap portion 190-2. As can be seen, for example, in FIG. 22, casing 165 may be appropriately dimensioned, and hook fasteners 197 and loop fasteners 199 may be appropriately positioned on casing 165 so that casing 165 may be wrapped around a bolster, and hook fasteners 197 and loop fasteners 199 may be secured to one another, thereby securing cushion 161 to the bolster. With cushion 161 thus secured to a bolster, if the bolster is moved to its "up" position, the wooden frame 123 that would then be positioned at the front of the bolster will be cushioned by cushion 161.

The embodiments of the present invention described above are intended to be merely exemplary and those skilled in the art shall be able to make numerous variations and modifications to it without departing from the spirit of the present invention. All such variations and modifications are intended to be within the scope of the present invention.

What is claimed is:

1. A cushion suitable for mounting on a bolster of a bolster-type boat seat, the cushion comprising:

(a) an insert, the insert comprising an impact damping material;

(b) a casing, the insert being disposed within the casing, the casing comprising a first end and a second end; and (c) a fastener detachably securing the first end of the casing to the second end of the casing;

(d) wherein the casing further comprises an insert enclosing portion, a first flap portion, and a second flap portion, the insert being enclosed within the insert enclosing portion of the casing, the first flap portion extending beyond one end of the insert enclosing portion and terminating at the first end of the casing, the second flap portion extending beyond an opposing end of the insert enclosing portion and terminating at the second end of the casing, wherein a piece of the casing extends from the first end of the casing to the second end of the casing, and wherein the fastener comprises complementary fasteners mounted on the first flap portion and the second flap portion of the casing, the complementary fasteners being directly detachably secured to one another.

2. The cushion as claimed in claim 1 wherein the insert comprises at least one foam pad.

3. The cushion as claimed in claim 1 wherein the insert enclosing portion of the casing comprises at least two additional pieces detachably joined to one another to permit the insert to be inserted into and/or removed from the insert enclosing portion of the casing, and wherein the at least two additional pieces detachably joined to one another are detachably joined to one another using at least one of a zipper and complementary hook and loop fasteners, and wherein detachment of the first flap portion and the second flap portion can be effected without detachment of the at least two additional pieces.

4. The cushion as claimed in claim 1 wherein the complementary fasteners comprise a hook and loop fastener mounted on the first flap portion of the casing and a complementary hook and loop fastener mounted on the second flap portion of the casing.

5. A method comprising:

(a) providing a bolster-type boat seat, the bolster-type boat seat comprising a boat seat and a bolster, the boat seat comprising a back portion and a seat portion, the bolster being pivotable relative to the boat seat between a down position wherein the bolster is in front of the seat portion of the boat seat and an up position wherein the bolster is on top of the seat portion of the boat seat, the bolster comprising a rigid frame;

(b) providing a cushion, the cushion comprising (i) an insert, the insert comprising an impact damping material, (ii) a casing, the insert being disposed within the casing, the casing comprising a first end and a second end, and (iii) a fastener for detachably securing the first end of the casing to the second end of the casing;

(c) wrapping the cushion around the bolster so that the insert is positioned over the rigid frame of the bolster; and (d) securing the first end of the casing to the second end of the casing.

6. The method as claimed in claim 5 wherein the insert comprises at least one foam pad.

7. The method as claimed in claim 5 wherein the casing comprises at least two pieces detachably joined to one another to permit the insert to be inserted into and/or removed from the casing and wherein the at least two pieces detachably joined to one another are detachably joined to one another using at least one of a zipper and complementary hook and loop fasteners.

8. The method as claimed in claim 5 wherein the casing comprises a first flap portion and a second flap portion, the first flap portion extending beyond one end of the insert, the second flap portion extending beyond an opposing end of the insert, wherein the fastener comprises a hook and loop fastener mounted on the first flap portion of the casing and a complementary hook and loop fastener mounted on the second flap portion of the casing, and wherein said wrapping step comprises overlapping one of the first flap portion of the casing and the second flap portion of the casing with the other.

* * * * *